US012378092B2

(12) United States Patent
Okada et al.

(10) Patent No.: US 12,378,092 B2
(45) Date of Patent: Aug. 5, 2025

(54) SHEET POSTPROCESSING APPARATUS THAT PERFORMS POSTPROCESSING ON PLURALITY OF SHEETS STACKED, AND IMAGE FORMING SYSTEM INCLUDING SAME

(71) Applicant: KYOCERA Document Solutions Inc., Osaka (JP)

(72) Inventors: Takehiko Okada, Osaka (JP); Yusuke Takano, Osaka (JP); Keisuke Egawa, Osaka (JP); Yasunori Ueno, Osaka (JP); Seiichi Shirasaki, Osaka (JP); Terumitsu Noso, Osaka (JP); Takuya Nishimura, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 18/419,737

(22) Filed: Jan. 23, 2024

(65) Prior Publication Data

US 2024/0253940 A1 Aug. 1, 2024

(30) Foreign Application Priority Data

Jan. 30, 2023 (JP) ..... 2023-012222

(51) Int. Cl.
*B65H 31/34* (2006.01)
*B65H 9/04* (2006.01)
(Continued)

(52) U.S. Cl.
CPC ..... *B65H 39/10* (2013.01); *B65H 9/04* (2013.01); *B65H 45/12* (2013.01); *B65H 2701/175* (2013.01); *B65H 2801/27* (2013.01)

(58) Field of Classification Search
CPC ..... B41L 43/12; B65H 31/02; B65H 31/34; B65H 27/00; B65H 45/12; B65H 45/18;
(Continued)

(56) References Cited

U.S. PATENT DOCUMENTS 8,226,076 B2 * 7/2012 Shirakuma ..... B65H 45/18 270/32
8,573,590 B2 * 11/2013 Shimizu ..... B65H 37/04 270/37
(Continued)

FOREIGN PATENT DOCUMENTS

JP 2007145570 A 6/2007
JP 2007314332 A * 12/2007
JP 2019206418 A 12/2019

*Primary Examiner* — Leslie A Nicholson, III
(74) *Attorney, Agent, or Firm* — IP Business Solutions, LLC.

(57) ABSTRACT

A sheet postprocessing apparatus includes a table configured to receive a plurality of sheets delivered thereto, and inclined downward toward a downstream side in a sheet delivery direction, a leading edge cursor provided on a far side on the table in the delivery direction, and configured to align respective leading edges of the sheets abutted against the leading edge cursor, and a postprocessing device including a stapling device that binds a central portion in the delivery direction, of the sheets stacked on the table, and a center folding device that folds the sheets along the central portion. The table includes an upper face region that allows the sheet to slide thereon, and a plurality of slip sheets of a belt-like shape, each extending on the upper face region along the delivery direction, with a clearance between each other in a width direction orthogonal to the delivery direction.

4 Claims, 16 Drawing Sheets

(51) Int. Cl.
*B65H 39/10* (2006.01)
*B65H 45/12* (2006.01)

(58) Field of Classification Search
CPC ..... B65H 2701/175; B65H 2301/4505; B65H 37/04; B65H 37/06; B65H 2404/522; B65H 2404/5311; B65H 2405/1142; B65H 2405/14; B65H 2405/1412
USPC ..... 270/37, 58.07, 58.08, 58.12, 58.17
See application file for complete search history.

(56) References Cited

U.S. PATENT DOCUMENTS

| | | | | |
|---|---|---|---|---|
| 8,876,106 | B2 * | 11/2014 | Koyama | B65H 33/08 271/215 |
| 9,145,278 | B2 * | 9/2015 | Sasaki | B65H 23/04 |
| 10,781,066 | B2 * | 9/2020 | Kishimoto | B65H 37/06 |
| 11,046,549 | B2 * | 6/2021 | Harada | B65H 31/02 |
| 11,091,344 | B2 * | 8/2021 | Ueno | B42C 1/12 |
| 2007/0120308 | A1 | 5/2007 | Takemoto et al. | |
| 2019/0367312 | A1 | 12/2019 | Kishimoto et al. | |

* cited by examiner

SHEET POSTPROCESSING APPARATUS THAT PERFORMS POSTPROCESSING ON PLURALITY OF SHEETS STACKED, AND IMAGE FORMING SYSTEM INCLUDING SAME

INCORPORATION BY REFERENCE

This application claims priority to Japanese Patent Application No. 2023-012222 filed on Jan. 30, 2023, the entire contents of which are incorporated by reference herein.

BACKGROUND

The present disclosure relates to a sheet postprocessing apparatus that performs postprocessing on a plurality of sheets stacked on each other, and an image forming system including the same. In particular, the present disclosure relates to a technique to align the edges of the stacked sheets.

In many of existing image forming apparatuses, an image reading device reads the image of a source document, and an image forming device forms the image of the source document on a recording sheet. In addition, sheet postprocessing apparatuses are known that receive the recording sheet, having the image of the source document formed thereon, from the image forming apparatus, and perform postprocessing on the recording sheet. The postprocessing performed by the sheet postprocessing apparatus includes, for example, a saddle binding operation including stacking a plurality of recording sheets on a table, aligning the edges of the recording sheets on the table, binding the center of the recording sheets, and folding the recording sheets. To perform the saddle binding operation, it is necessary to properly align the recording sheets on the table.

For example, some existing sheet loading mechanisms are configured to transport a plurality of sheets to a sheet table, receive the sheets delivered to the sheet table with a sheaf lifting cursor, thereby aligning the leading edges of the sheets, move a sheaf lowering cursor so as to abut against the trailing edges of the sheets on the sheet table, thereby aligning the trailing edges of the sheets, and move the sheaf lifting cursor and the sheaf lowering cursor, to move the sheaf of sheets along the sheet table.

Further, some existing sheet postprocessing apparatuses include an upper moving member and a lower moving member for aligning the leading edges and the trailing edges of the sheets delivered to a sheet loading section. In this case, the leading edges of the sheets are abutted against the lower moving member, and the upper moving member and the lower moving member are moved by a distance according to the size of the sheet (length in the sheet transport direction), such that the positions of the sheets stacked on the sheet loading section are aligned with each other.

SUMMARY

The disclosure proposes further improvement of the foregoing techniques.

In an aspect, the disclosure provides a sheet postprocessing apparatus including a table, a leading edge cursor, and a postprocessing device. The table is configured to receive a plurality of sheets delivered thereto, and inclined downward toward a downstream side in a sheet delivery direction. The leading edge cursor is provided on a far side on the table in the delivery direction, and configured to align respective leading edges of the sheets abutted against the leading edge cursor. The postprocessing device includes a stapling device that binds a central portion in the delivery direction, of the sheets stacked on the table, and a center folding device that folds the sheets along the central portion. The table includes an upper face region that allows the sheet to slide thereon, and a plurality of slip sheets of a belt-like shape, each extending on the upper face region along the delivery direction, with a clearance between each other in a width direction orthogonal to the delivery direction.

In another aspect, the disclosure provides an image forming system, including an image forming apparatus having an image forming device that forms an image of a source document on a sheet, and the foregoing sheet postprocessing apparatus that receives the sheet from the image forming apparatus, and performs postprocessing.

DETAILED DESCRIPTION

Figure 1:
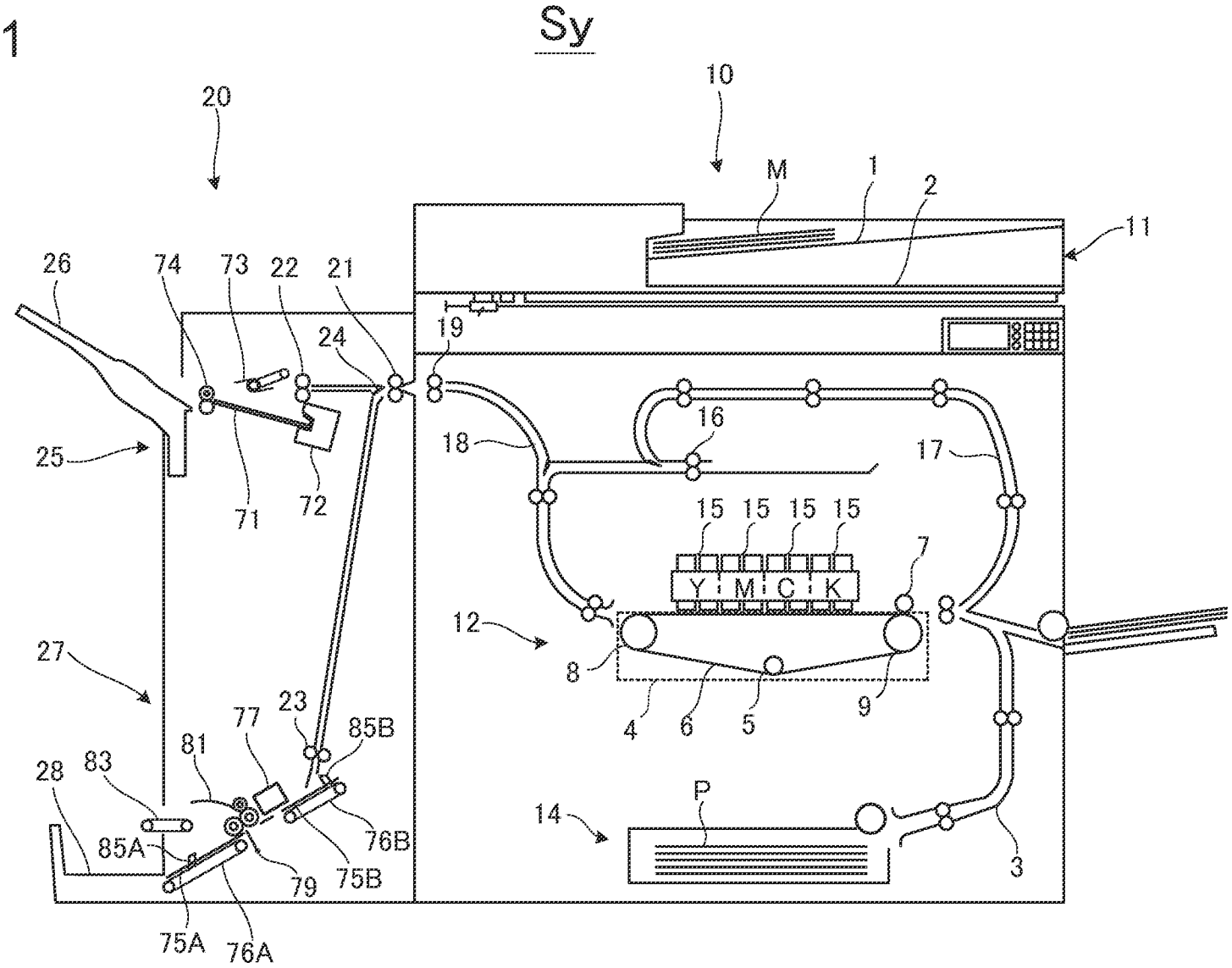
FIG. 1 is a cross-sectional view showing an image forming apparatus and a sheet postprocessing apparatus, constituting an image forming system according to an embodiment of the disclosure.

Hereafter, a sheet postprocessing apparatus according to an embodiment of the disclosure, and an image forming system including the same will be described, with reference to the drawings. FIG. 1 is a cross-sectional view showing an image forming apparatus and the sheet postprocessing apparatus, constituting the image forming system according to the embodiment of the disclosure. The image forming system Sy according to the embodiment includes the image forming apparatus 10 that reads an image of a source document and forms the image on a recording sheet P (corresponding to the sheet in the disclosure), and the sheet postprocessing apparatus 20 that receives the recording sheet from the image forming apparatus 10, and performs postprocessing on the recording sheet.

The image forming apparatus 10 includes an image reading device 11 and an image forming device 12. When a plurality of source documents M are placed on a document tray 1, the image reading device 11 sequentially draws out the source documents M from the document tray 1 one by one, reads the image of each of the source documents M with an image sensor, and sequentially delivers the source documents M to a discharge tray 2, so as to stack the source documents M on each other. The image reading device 11 converts the analog output from the image sensor is converted to a digital signal, with respect to each of the images of the source documents M, and image data representing the image of each of the source documents M is generated.

The image forming device 12 forms the image of the source document M represented by the image data, on the recording sheet P through an ink jet process, each time the image data representing the image of each of the source documents M is inputted. The image forming device 12 includes line heads 15 that respectively eject ink of four colors, namely black, cyan, magenta, and yellow. The line heads 15 is a example of a ink head. The line heads 15 each eject the ink droplets of the corresponding color onto the recording sheet P, delivered to a conveying unit 4 from a sheet feeding device 14 through a first transport route 3, thereby forming a color image on the recording sheet P.

The conveying unit 4 includes a drive roller 8, a follower roller 9, a tension roller 5, and a transport belt 6. The transport belt 6 is an endless belt stretched around the drive roller 8, the follower roller 9, and the tension roller 5. The drive roller 8 is driven by a non-illustrated motor so as to rotate counterclockwise. When the drive roller 8 is made to rotate, the transport belt 6 revolves counterclockwise, and the follower roller 9 and the tension roller 5 are each passively made to rotate counterclockwise, by the transport belt 6.

The tension roller 5 serves to maintain the tension of the transport belt 6 at an appropriate level. The transport belt 6 is in contact with an adsorption roller 7. The adsorption roller 7 electrically charges the transport belt 6, to thereby electrostatically adsorb the recording sheet P delivered from the sheet feeding device 14, to the transport belt 6.

The images of the source documents M are formed on the respective recording sheets P by the image forming device 12, and the recording sheets P are transported to the sheet postprocessing apparatus 20, through a relay transport route 18 and a transport roller 19.

When the image of the source document M is also to be formed on the back face of the recording sheet P, the image forming apparatus 10 performs switchback transport, including transporting the recording sheet P from the relay transport route 18 to the transport roller 16, temporarily stopping the transport roller 16, and then reversely rotating the same. Then the recording sheet P is returned to the conveying unit 4 through a second transport route 17, with the front and back faces reversed. When the image forming device 12 forms the image of the source document M on the back face of the recording sheet P, the recording sheet P is transported to the sheet postprocessing apparatus 20, through the relay transport route 18 and the transport roller 19.

The sheet postprocessing apparatus 20 includes a plurality of transport rollers 21, 22 and a delivery roller 23 for transporting the recording sheet P delivered from the image forming apparatus 10, a branching nail 24, an edge binding device 25, an output tray 26, a saddle binding device 27, and an output tray 28.

The branching nail 24 switches the direction of the recording sheet P that has passed the transport roller 21, between a horizontal route toward the transport roller 22, and a downward route toward the delivery roller 23.

The edge binding device 25 performs stapling operation on an end portion of a plurality of recording sheets P stacked on each other. The output tray 26 receives the recording sheets P, that have undergone the stapling operation by the edge binding device 25. The saddle binding device 27 performs the stapling operation on the central position of a plurality of recording sheets P stacked on each other, and folds the recording sheets P along the central position. The output tray 28 receives the recording sheets P, stapled and folded by the saddle binding device 27. The saddle binding device 27 exemplifies the postprocessing device in the disclosure.

The edge binding device 25 includes a processing tray 71 for sequentially receiving the plurality of recording sheets P delivered through the transport rollers 21 and 22, a paddle 73 that biases the recording sheet P so as to move toward the stapling device 72, each time the recording sheet P is delivered to the processing tray 71, a stapling device 72 that performs the stapling operation on an end portion of the plurality of recording sheets P stacked on the processing tray 71, and a delivery roller 74 that delivers the recording sheets P that have undergone the stapling operation by the stapling device 72, to the output tray 26.

Figure 2:
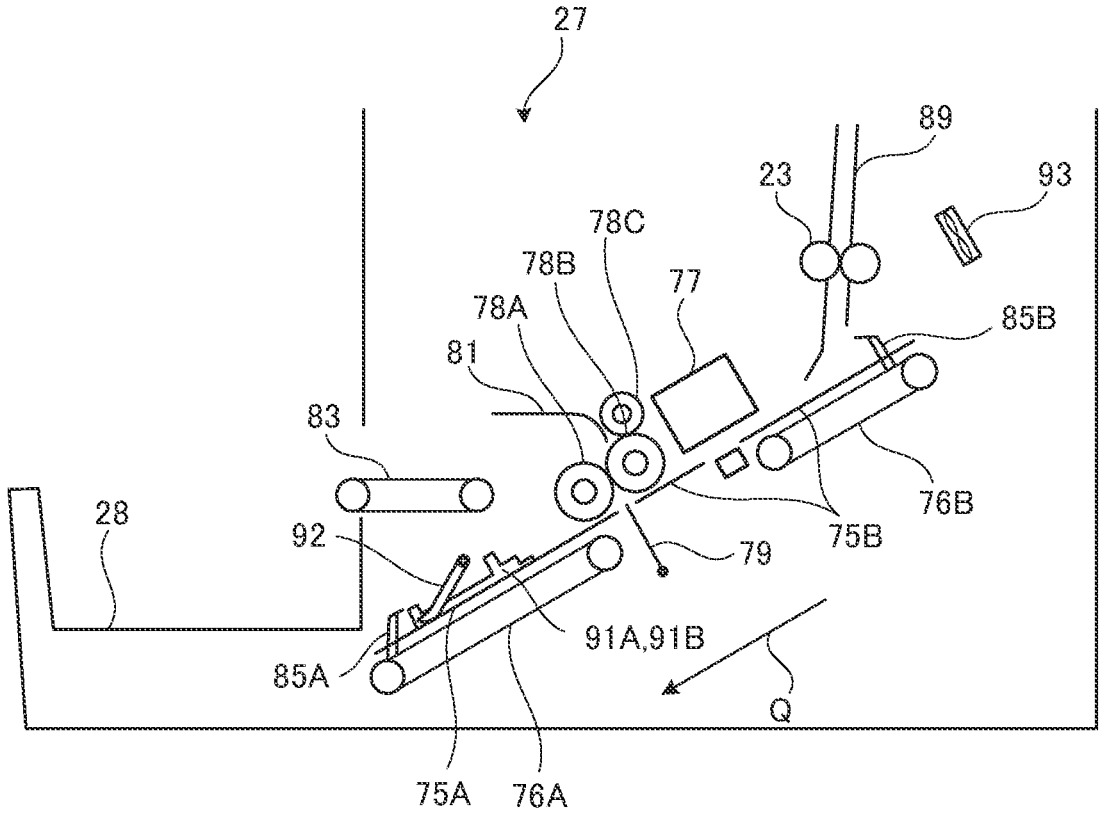
FIG. 2 is an enlarged cross-sectional view showing a saddle binding device in the sheet postprocessing apparatus.

Hereunder, the saddle binding device 27 will be described. FIG. 2 is an enlarged cross-sectional view showing the saddle binding device 27 in the sheet postprocessing apparatus 20.

As shown in FIG. 1 and FIG. 2, the saddle binding device 27 includes divided tables 75A and 75B, a leading edge cursor 85A and a trailing edge cursor 85B, revolving belts 76A and 76B, a stapling device 77, folding rollers 78A, 78B, and 78C, a folding blade 79, a guide 81, a delivery conveyor 83, side-edge cursors 91A and 91B, a first pressing member 92, and a blowing fan 93.

The divided tables 75A and 75B are each configured to receive a plurality of recording sheets P, transported and delivered by the delivery roller 23. The divided tables 75A and 75B are inclined downward toward the downstream side in the delivery direction of the recording sheet P, so as to receive the plurality of recording sheets P delivered thereto. The leading edge cursor 85A and the trailing edge cursor 85B move the recording sheets P on the divided tables 75A and 75B, thereby regulating the position of the recording sheets P in the longitudinal direction. The revolving belts 76A and 76B support the respective cursors 85A and 85B, and cause the cursors 85A and 85B to reciprocate along the delivery direction of the recording sheet P. The leading edge cursor 85A is located on the far-end side of the divided table 75A, in the delivery direction. The respective leading edges of the recording sheets P are abutted against the leading edge cursor 85A, so that the leading edges of the recording sheets P are aligned with each other. The divided tables 75A and 75B each include an upper face (corresponding to the upper face region in the disclosure) that allows the recording sheet P to slide thereon.

The stapling device 77, constituted of a known stapling device, performs the stapling operation on the central position of the recording sheets P stacked on the divided tables 75A and 75B. The folding rollers 78A, 78B, and 78C are located above the space between the divided tables 75A and 75B, and folds the recording sheets P and transports the same. The folding blade 79 is an elongate plate-shaped member extending in the width direction, and oriented such that the longitudinal edge is erected toward a nip region between the folding rollers 78A and 78B. The folding blade 79 is opposed to the nip region, and made to reciprocate toward and away from the nip region, through the space between the divided tables 75A and 75B.

The guide 81 receives the recording sheets P from the folding rollers 78A and 78B, and guides the recording sheets P. The delivery conveyor 83 transports the recording sheets P toward the output tray 28, and delivers thereto the recording sheets P. The side-edge cursors 91A and 91B are provided on the respective sides of the divided table 75A, to regulate the position of the recording sheet P in the width direction.

The first pressing member 92 presses the leading edge (the proximity thereof inclusive, the same hereinafter) of the recording sheets P on the divided table 75A. The blowing fan 93 blows air into the region on the lower side of the recording sheet P being delivered to the divided table 75B.

Hereunder, the folding operation of the recording sheets P, performed by the saddle binding device 27, will be described. FIG. 3A to FIG. 3D each illustrate the folding operations of the recording sheet P, performed by the saddle binding device 27.

Figure 3A:
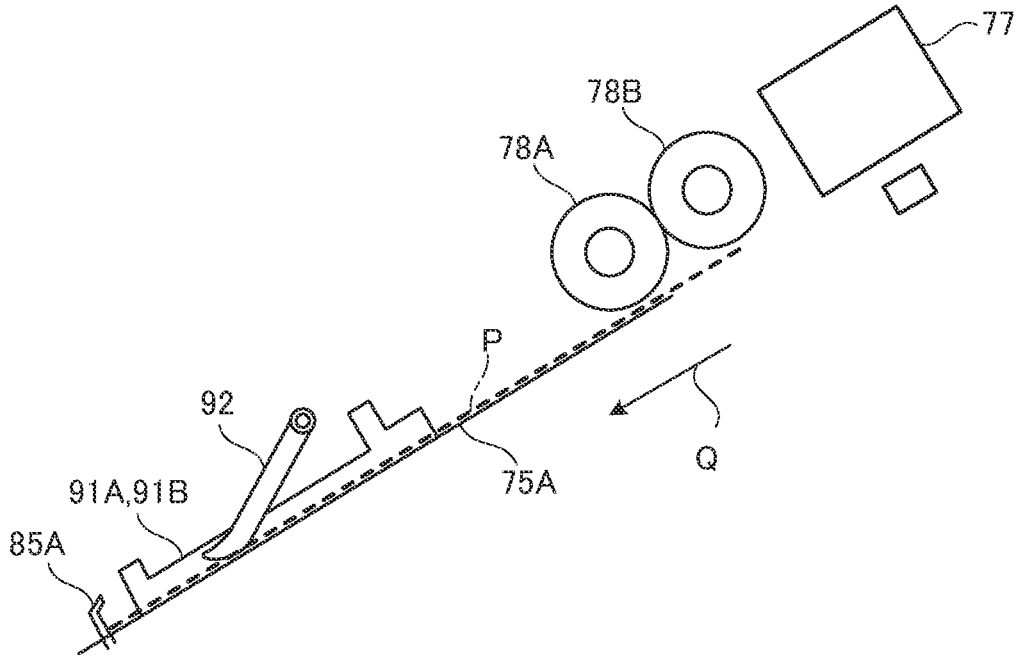
FIG. 3A and FIG. 3B are schematic drawings for explaining an operation of a saddle binding operation, performed by the saddle binding device on a recording sheet.

When the recording sheet P is transported toward the divided tables 75A and 75B and delivered thereto, as shown in FIG. 3A, the leading edge of the recording sheet P is abutted against the leading edge cursor 85A thus to be set in position, and also the respective side edges of the recording sheet P are set in position by the side-edge cursors 91A and 91B, and the first pressing member 92 presses a position on the recording sheet P in the proximity of the leading edge. Then the trailing edge of the recording sheet P is abutted against the trailing edge cursor 85B, either by the movement of the leading edge cursor 85A along the sheet transport direction toward the trailing edge cursor 85B, or by the movement of the trailing edge cursor 85B along the sheet transport direction toward the leading edge cursor 85A. Thereafter, the leading edge cursor 85A or the trailing edge cursor 85B is moved to the initial position. The divided tables 75A and 75B are sloped obliquely downward in the sheet delivery direction, and therefore the recording sheet P is biased obliquely downward by the self-weight, on the divided tables 75A and 75B. Accordingly, the leading edge of the recording sheet P remains abutted against the leading edge cursor 85A. Through the repetition of such actions, a plurality of recording sheets P are stacked on the divided tables 75A and 75B, with the edges aligned. Here, the leading edge cursor 85A, the side-edge cursors 91A and 91B, and the trailing edge cursor 85B may be moved as above, each time a predetermined number of recording sheets P are delivered to the divided tables 75A and 75B, so that the respective leading edges, side edges, and trailing edges of those recording sheets P are aligned by the respective cursors, and that resultantly a plurality of recording sheets P are stacked on the divided tables 75A and 75B, with the edges aligned.

Figure 3B:
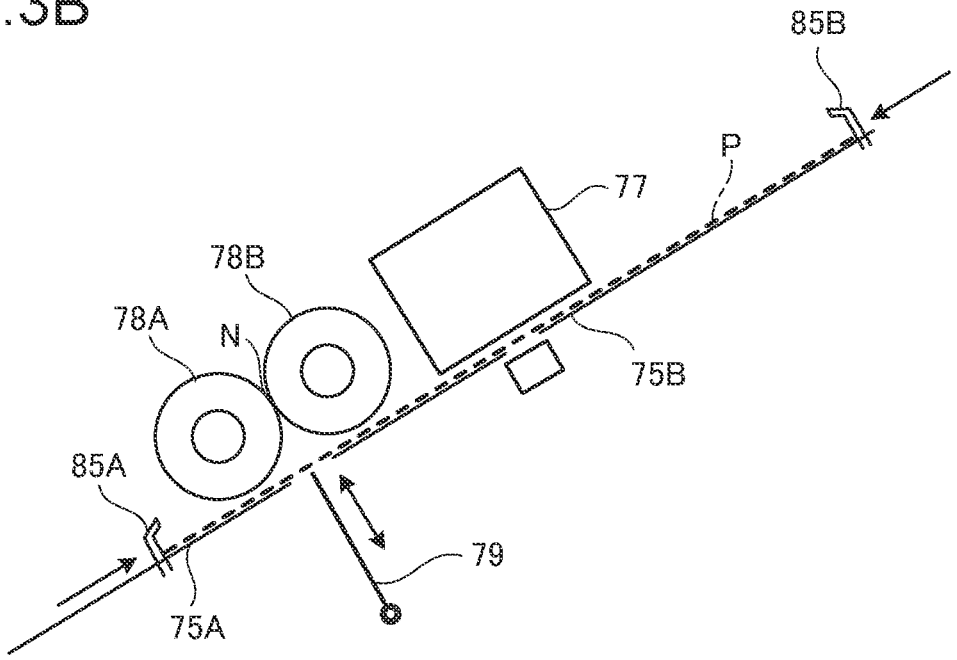

When the stapling operation is to be performed thereafter, the leading edge cursor 85A and the trailing edge cursor 85B are moved to the position shown in FIG. 3B, so that the recording sheets P are moved on the divided tables 75A and 75B. As result, the center of the recording sheets P is set at the position for the stapling operation by the stapling device 77, and the stapling device 77 performs the stapling operation onto the center of the recording sheets P.

Figure 3C:
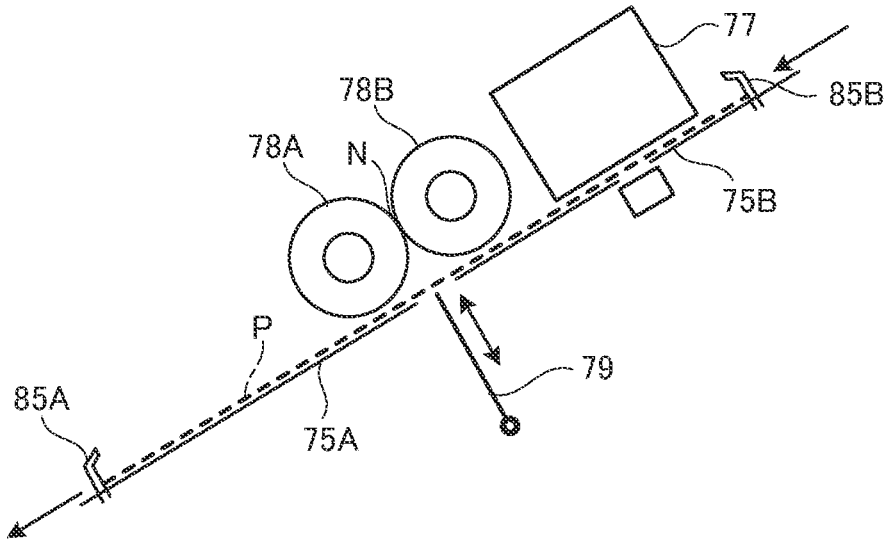
FIG. 3C and FIG. 3D are schematic drawings for explaining the operation of the saddle binding operation, performed by the saddle binding device on the recording sheet.

Then the cursors 85A and 85B are moved, so that the position of the recording sheets P on the divided tables 75A and 75B is shifted, as shown in FIG. 3C. As result, the center of the recording sheet P in the sheet transport direction is set in position, in the space between the divided tables 75A and 75B.

Figure 3D:
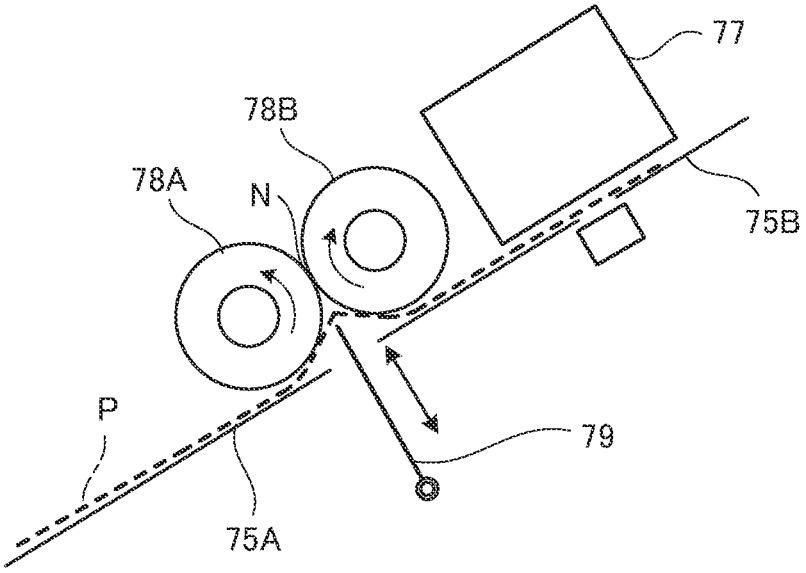

Proceeding to FIG. 3D, the folding roller 78A is driven to rotate counterclockwise in FIG. 3D, and the folding roller 78B is driven to rotate clockwise in FIG. 3D. The folding blade 79 is located at the position corresponding to the nip region N between the folding rollers 78A and 78B. When the folding blade 79 is moved toward the recording sheets P and then toward the nip region N, the central portion of the recording sheets P is lifted up by the tip portion of the folding blade 79. As result, the central portion of the recording sheets P is squeezed into the nip region N between the folding rollers 78A and 78B, and the recording sheets P are folded along the center by the folding rollers 78A and 78B, thus to be double-folded. The recording sheets P folded as above are transported by the folding rollers 78A and 78B, and then guided by the guide 81 to the delivery conveyor 83, which transports and delivers the recording sheets P to the output tray 28.

Here, the folding roller 78C shown in FIG. 2 serves to fold the recording sheets P along an additional position after the recording sheets P are double-folded, thereby triple-folding the same. However, the description of the triple-folding operation will be skipped.

Figure 4:
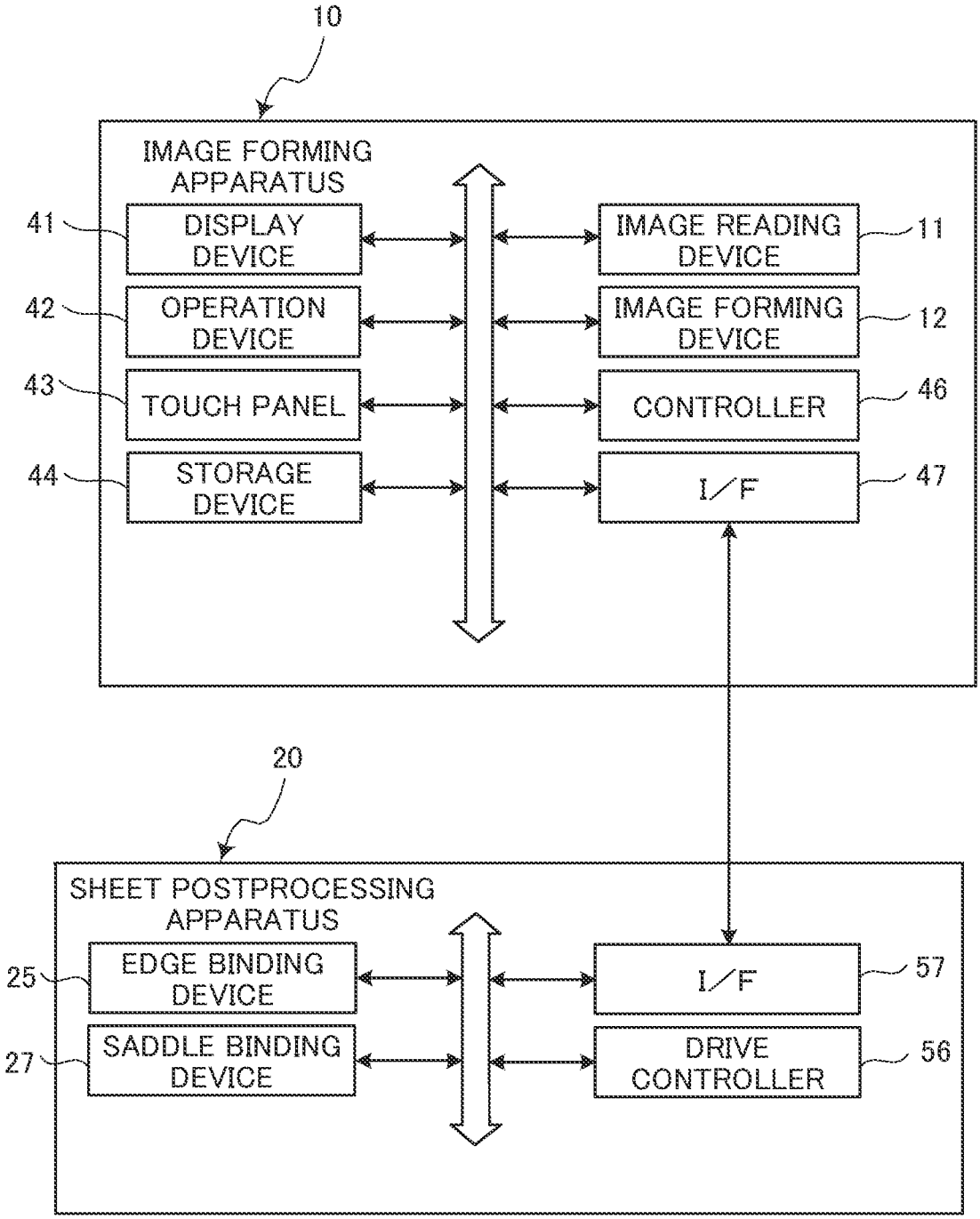
FIG. 4 is a functional block diagram showing an essential internal configuration of an image forming apparatus and the sheet postprocessing apparatus.

Hereunder, a configuration related to the control operation of the image forming apparatus 10 and the sheet postprocessing apparatus 20 will be described. FIG. 4 is a functional block diagram showing an essential internal configuration of the image forming apparatus 10 and the sheet postprocessing apparatus 20. As shown in FIG. 4, the image forming apparatus 10 includes the image reading device 11, the image forming device 12, a display device 41, an operation device 42, a touch panel 43, a storage device 44, a controller 46, and an interface (hereinafter, I/F) 47. The mentioned components are configured to transmit and receive data and signals to and from each other, via a bus.

The display device 41 is, for example, constituted of a liquid crystal display (LCD) or an organic light-emitting diode (OLED) display.

The operation device 42 includes physical keys such as a numeric keypad, an enter key, and a start key. The operation device 42 receives inputs of various instructions, corresponding to the user's operation performed on the mentioned keys.

A touch panel 43 is overlaid on the screen of the display device 41. The touch panel 43 is based on what is known as a resistive film or electrostatic capacitance, and configured to detect a contact (touch) of the user's finger made thereon, along with the touched position, and output a detection signal indicating the coordinate of the touched position, to the controller 46.

The storage device 44 is a large-capacity storage device such as a solid-state drive (SSD) or a hard disk drive (HDD), and contains various application programs and various types of data.

The controller 46 includes a processor, a random-access memory (RAM), a read-only memory (ROM), and so forth. The processor is, for example, a central processing unit (CPU), an application specific integrated circuit (ASIC), or a micro processing unit (MPU). The controller 46 acts as a processing device that executes the control program stored in the ROM or the storage device 44, thereby executing various processings necessary for the image forming job by the image forming apparatus 10.

The controller 46 is connected to the image reading device 11, the image forming device 12, the display device 41, the operation device 42, the touch panel 43, the storage device 44, and the I/F 47. The controller 46 controls the operation of the components cited above, and transmits and receives signals and data to and from those components.

The controller 46 is also configured to control the displaying operation of the display device 41. Further, the controller 46 receives the instruction inputted by the user, on the basis of the detection signal outputted from the touch panel 43 or a press of the physical key on the operation device 42. For example, the controller 46 receives the instruction according to a touch operation, performed through the touch panel 43 on the graphical user interface (GUI) displayed on the screen of the display device 41.

The sheet postprocessing apparatus 20 includes the edge binding device 25, the saddle binding device 27, a drive controller 56, and an I/F 57. These components are configured to transmit and receive data and signals to and from each other, via a bus.

The drive controller 56 includes a processor, a RAM, and a ROM, and controls the operation of the edge binding device 25 and the saddle binding device 27. The drive controller 56 exemplifies the controller in the disclosure.

The controller 46 of the image forming apparatus 10 and the drive controller 56 of the sheet postprocessing apparatus 20 are configured to input and output data and signals between each other, via the respective I/Fs 47 and 57. For example, the controller 46 of the image forming apparatus 10 outputs a control signal, indicating the postprocessing to be performed by the sheet postprocessing apparatus 20 and the size of the recording sheet P, to the drive controller 56 of the sheet postprocessing apparatus 20, and the drive controller 56 of the sheet postprocessing apparatus 20 controls the edge binding device 25 or the saddle binding device 27, according to the control signal received.

In the image forming system Sy configured as above, for example when the image forming apparatus 10 is made to read the images of a plurality of documents M and form the respective images on the recording sheets P, and the saddle binding device 27 of the sheet postprocessing apparatus 20 is made to perform the saddle binding operation including binding the central position of the recording sheets P and folding the recording sheets P at the central position, an instruction to perform the saddle binding operation, and designation of the size (length and width) of the recording sheet P are inputted through the touch panel 43, on the basis of the user's operation performed on the GUI displayed on the screen of the display device 41. Then the user sets a plurality of documents M on the image reading device 11, and inputs an instruction to execute a copying operation, through the operation device 42. The controller 46 receives the instruction to perform the saddle binding operation, the designation of the size of the recording sheet P, and the instruction to execute the copying operation.

The controller 46 of the image forming apparatus 10 outputs a control signal indicating the instruction to perform the saddle binding operation and the size of the recording sheet P to the sheet postprocessing apparatus 20 through the I/F 47. The controller 46 also causes the image reading device 11 to sequentially read the images of the respective documents M, causes the image forming device 12 to form those images on the respective recording sheets P, and sequentially delivers the recording sheets P, each having the image formed thereon, to the sheet postprocessing apparatus 20.

The drive controller 56 of the sheet postprocessing apparatus 20 receives the instruction to perform the saddle binding operation and the size of the recording sheet P, through the I/F 57. Then the drive controller 56 drives the plurality of transport rollers 21, the branching nail 24, and the delivery roller 23, so as to transport the recording sheets P, delivered from the image forming apparatus 10, to the saddle binding device 27 according to the control signal received. Further, the drive controller 56 activates motors that respectively serve as drive sources for the revolving belts 76A and 76B, the stapling device 77, the folding rollers 78A and 78B, the folding blade 79, the delivery conveyor 83, the side-edge cursors 91A and 91B, and the blowing fan 93, in the saddle binding device 27. As result, the stapling operation is performed on the center of the recording sheet P in the sheet transport direction, and the recording sheets P are folded along the center and delivered to the output tray 28.

For example, a stepping motor may be employed, as the drive source for the side-edge cursors 91A and 91B. In addition, a conversion mechanism may be provided that converts the rotative force of the stepping motor, into linear driving force that causes the side-edge cursors 91A and 91B to move toward and away from each other. Such conversion mechanism provides the driving force for linear movement, to the side-edge cursors 91A and 91B.

The conversion mechanism includes, for example, rack gears respectively connected to the side-edge cursors 91A and 91B. The rack gear is attached to each of the side-edge cursors 91A and 91B, so as to extend toward the other cursor. Such rack gears are oriented parallel to each other, and movable, together with the cursor, in the width direction orthogonal to the sheet delivery direction. The rack gears are each meshed with a pinion gear. The conversion mechanism is configured to rotate the pinion gear in the forward or reverse direction, thereby moving the corresponding rack gear in the width direction, so that the side-edge cursors 91A and 91B are moved toward or away from each other. The pinion gear can be made to rotate in the forward or reverse direction, by the stepping motor.

The drive controller 56 moves the side-edge cursors 91A and 91B, by controlling the rotation direction and the rotation angle of the stepping motor. To be more specific, the drive controller 56 controls the rotation direction and the rotation angle of the stepping motor, to thereby move the side-edge cursors 91A and 91B to a standby position, where the cursors are most distant from each other. The position of each of the side-edge cursors 91A and 91B in the width direction is detected by a non-illustrated sensor (e.g., optical sensor). The drive controller 56 moves the side-edge cursors 91A and 91B to the standby position, on the basis of the detection output from the sensor. Then the drive controller 56 moves the side-edge cursors 91A and 91B from the standby position, toward each other by a distant determined according to the width of the recording sheet P. Thus, the drive controller 56 moves the side-edge cursors 91A and 91B in the width direction, to the position where the cursors make contact with the respective side edges of the recording sheet P, thereby regulating the position in the width direction, of the recording sheet P delivered to the divided tables 75A and 75B.

A stepping motor may also be employed as a belt drive source for causing the revolving belt 76A to revolve endlessly. The revolving belt 76A is provided with a mechanism (e.g., gear unit and pulley) that transmits the rotation of the stepping motor to the revolving belt 76A. The drive controller 56 causes the revolving belt 76A to revolve, thereby moving the leading edge cursor 85A mounted on the revolving belt 76A, by controlling the rotation direction and the rotation angle of the stepping motor. The position of the leading edge cursor 85A is detected by a non-illustrated sensor. The drive controller 56 controls the action of the stepping motor on the basis of the detection output from the sensor, thereby moving the leading edge cursor 85A to a predetermined standby position.

Likewise, another stepping motor may be employed as a belt drive source for the revolving belt 76B. The revolving belt 76B is provided with a mechanism (e.g., a gear unit and a pulley) that transmits the rotation of the stepping motor to the revolving belt 76B. The drive controller 56 causes the revolving belt 76B to revolve, thereby moving the trailing edge cursor 85B mounted on the revolving belt 76B, by controlling the rotation direction and the rotation angle of the stepping motor. The position of the trailing edge cursor 85B is detected by a non-illustrated sensor. The drive controller 56 controls the action of the stepping motor on the basis of the detection output from the sensor, thereby moving the trailing edge cursor 85B to a predetermined standby position.

When the recording sheet P is delivered to the divided tables 75A and 75B, with the cursors 85A and 85B set at the standby position, the leading edge of the recording sheet P is abutted against the leading edge cursor 85A. At this point, the drive controller 56 drives the cursor drive source, so as to move the side-edge cursors 91A and 91B to the contact position with the respective side edges of the recording sheet P. Accordingly, the recording sheet P is set in position, in the width direction. Then the drive controller 56 either causes the revolving belt 76A to revolve, thereby moving the leading edge cursor 85A toward the trailing edge cursor 85B, by controlling the rotation direction and the rotation angle of the belt drive source for the revolving belt 76A, or causes the revolving belt 76B to revolve, thereby moving the trailing edge cursor 85B toward the leading edge cursor 85A, by controlling the rotation direction and the rotation angle of the belt drive source for the revolving belt 76B. As result, the trailing edge of the recording sheet P is abutted against the trailing edge cursor 85B. At this point, the drive controller 56 moves the trailing edge cursor 85B in the direction away from the leading edge cursor 85A, toward a position spaced therefrom by a distance slightly longer than the length of the recording sheet P. As result, the trailing edge of the recording sheet P is set in position by the trailing edge cursor 85B, as shown in FIG. 3B. The drive controller 56 then moves the leading edge cursor 85A and the trailing edge cursor 85B to the respective standby positions. At this point, the recording sheet P remains abutted against the leading edge cursor 85A, on the divided tables 75A and 75B.

The mentioned operation is repeated each time one recording sheet P is delivered to the divided tables 75A and 75B, so that a plurality of recording sheets P are stacked on the divided tables 75A and 75B, with the respective edges aligned with each other. Thereafter, the drive controller 56 moves the recording sheets P on the divided tables 75A and 75B using the leading edge cursor 85A and the trailing edge cursor 85B, by controlling the rotation direction and the rotation angle of the respective belt drive sources for the revolving belts 76A and 76B, such that, as shown in FIG. 3B, the center of the recording sheet P in the longitudinal direction (i.e., sheet delivery direction), in other words the position on the recording sheet P, spaced from the leading edge cursor 85A by a distance corresponding to a half of the length of the recording sheet P, is positioned for the stapling operation by the stapling device 77.

Then the drive controller 56 causes the stapling device 77 to perform the stapling operation, onto the center of the recording sheets P. Thereafter, the drive controller 56 moves the center of the recording sheets P in the longitudinal direction using the leading edge cursor 85A and the trailing edge cursor 85B, to the position corresponding to the space between the folding rollers 78A and 78B as shown in FIG. 3C, by controlling the rotation direction and the rotation angle of the respective belt drive sources for the revolving belts 76A and 76B, Further, a linear movement mechanism, configured to convert the rotation of the motor serving as the blade drive source, to the linear movement of the folding blade 79, is provided. The linear movement mechanism supports the folding blade 79 so as to move toward and away from the nip region N between the folding rollers 78A and 78B, and includes a coil spring biasing the folding blade 79 in the direction away from the nip region N. The linear movement mechanism includes a cam that pushes the end portion of the folding blade 79 on the opposite side of the nip region N, in other words the rear end portion of the folding blade 79, thereby moving the folding blade 79 toward the nip region N, against the biasing force of the coil sprint. The cam is made to rotate in one direction, by the driving force of the motor. The drive controller 56 sets the folding blade 79 at the standby position, by controlling the rotation of the motor. The position of the folding blade 79 is detected by a non-illustrated sensor (e.g., optical sensor). The drive controller 56 sets the folding blade 79 at the standby position most distant from the nip region N between the folding rollers 78A and 78B, on the basis of the detection output from the sensor.

The drive controller 56 causes the folding blade 79 to move from the standby position shown in FIG. 3C to the position closest to the nip region N shown in FIG. 3D, thereby causing the folding blade 79 to squeeze the central portion of the recording sheets P into the nip region N between the folding rollers 78A and 78B. Thereafter, the drive controller 56 returns the folding blade 79 to the standby position.

In addition, a known transmission mechanism (e.g., gear unit) is provided that converts the rotation of the motor serving as the drive source for each of the folding rollers 78A and 78B, to the counterclockwise rotation of the folding roller 78A and the clockwise rotation of the folding roller 78B. The drive controller 56 controls the rotation of such motors, thereby causing the folding roller 78A to rotate counterclockwise in FIG. 3D, and causing the folding roller 78B to rotate clockwise in FIG. 3D. As result, the recording sheets P are caught between the nip region N, thus to be folded along the center of the recording sheets P.

The drive controller 56 causes the delivery conveyor 83 to deliver the recording sheet P folded as above to the output tray 28, by controlling the rotation of the motor serving as the drive source for the delivery conveyor 83.

Referring now to FIG. 5 to FIG. 13, the configuration of the saddle binding device 27 of the sheet postprocessing apparatus 20 will be described in detail.

Figure 5:
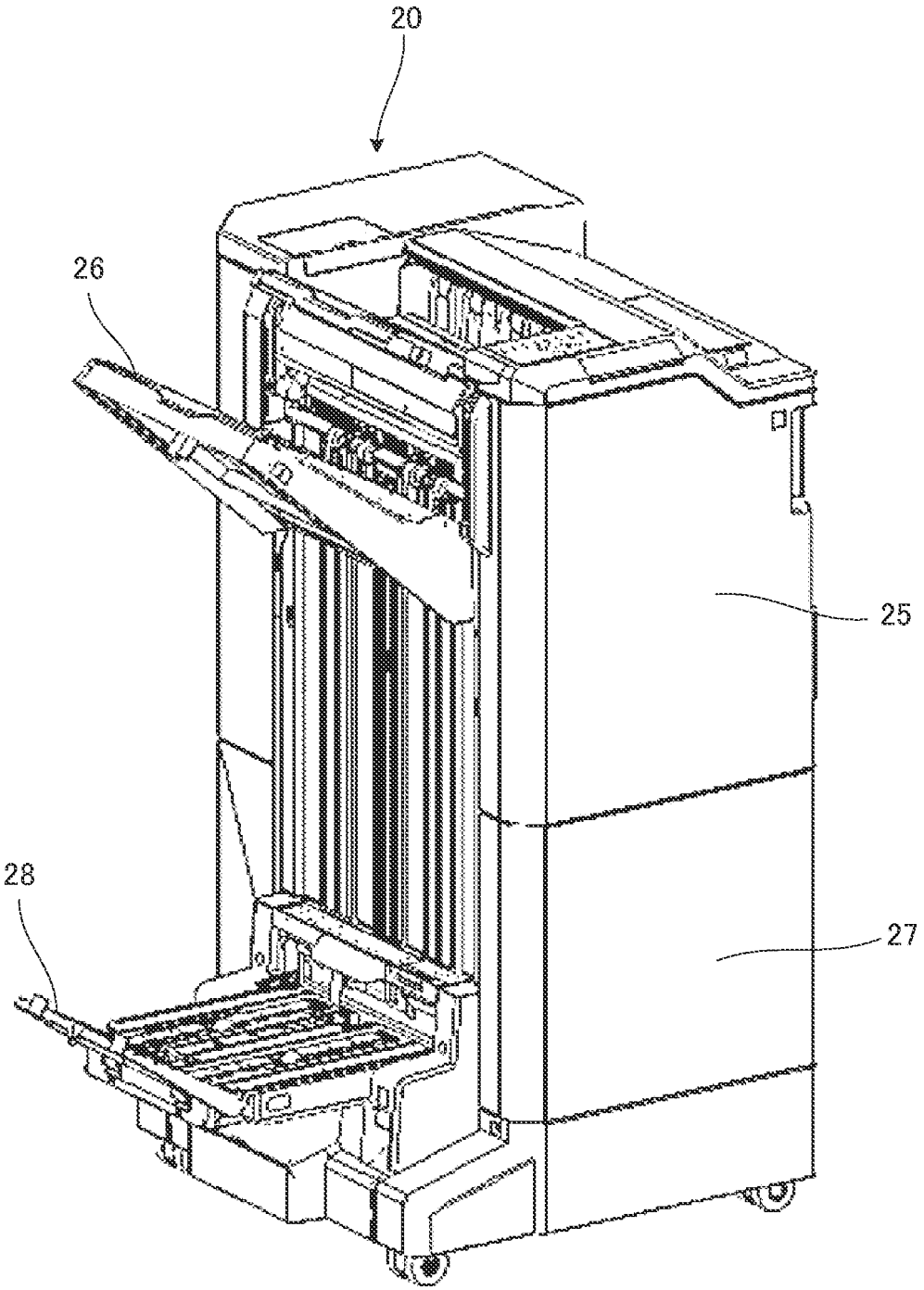
FIG. 5 is a perspective view showing the appearance of the sheet postprocessing apparatus.

FIG. 5 is a perspective view showing the sheet postprocessing apparatus 20. As shown in FIG. 5, the edge binding device 25 and the output tray 26 are provided in the upper portion of the sheet postprocessing apparatus 20, and the saddle binding device 27 and the output tray 28 are provided in the lower portion of the sheet postprocessing apparatus 20.

Figure 6A:
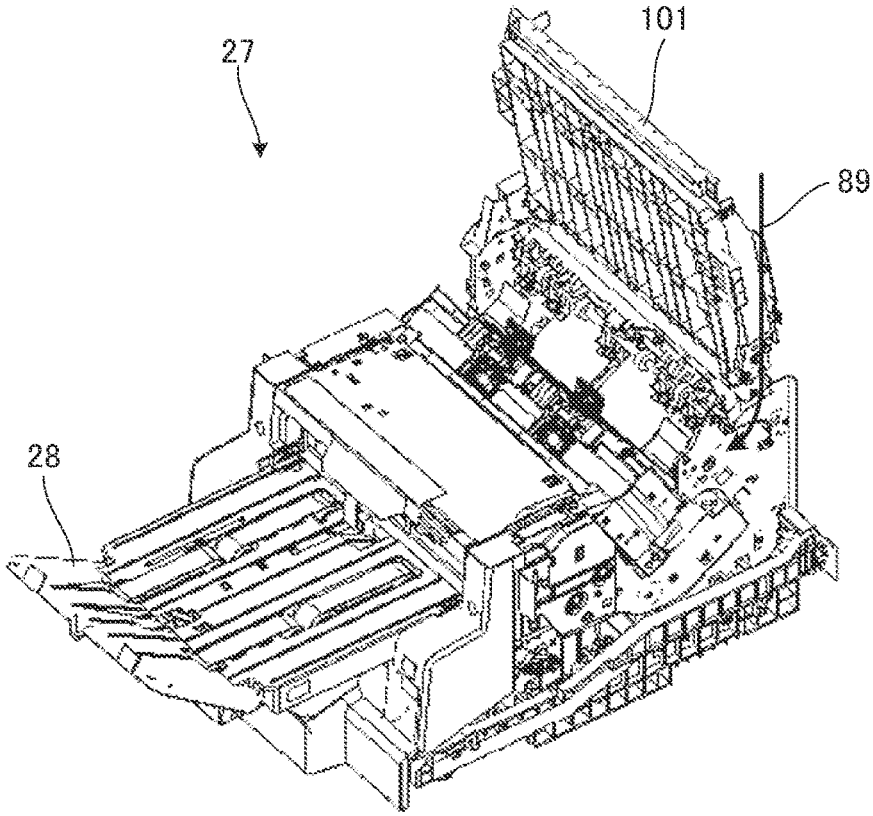
FIG. 6A is a front perspective view of the saddle binding device seen from an obliquely upper position.
Figure 6B:
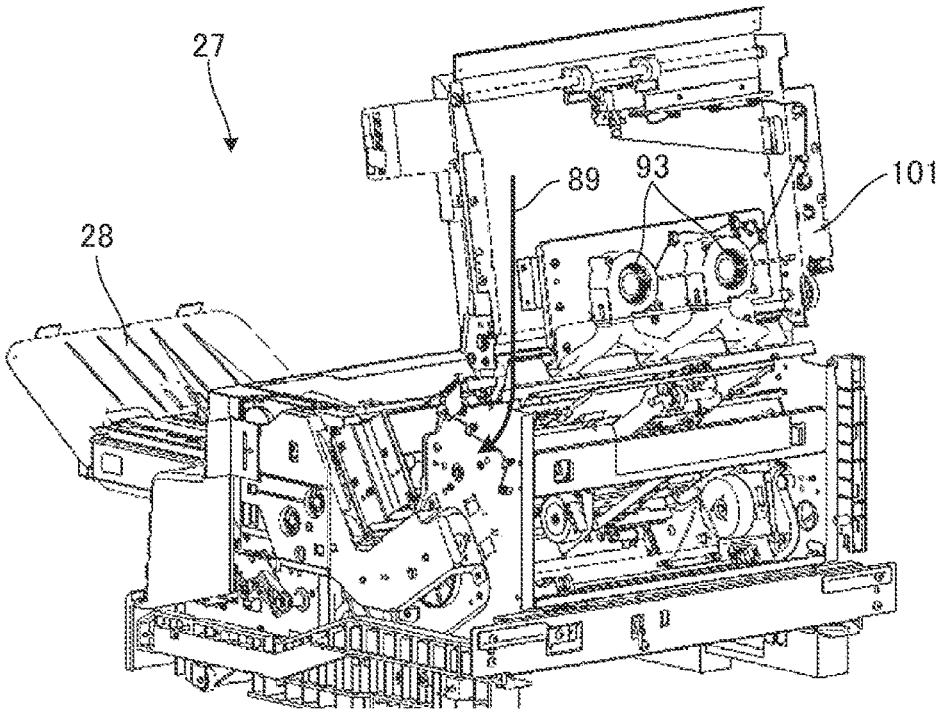
FIG. 6B is a perspective view of the saddle binding device seen from the back, with a back cover thereof opened upward.

FIG. 6A is a perspective view of the saddle binding device 27, seen from an obliquely upper position on the side to which the recording sheet P is delivered (front side). FIG. 6B is a perspective view of the saddle binding device 27 seen from the back. FIG. 6A and FIG. 6B illustrate the state where a back cover 101 of the saddle binding device 27 is opened upward.

The recording sheet P is transported downward along a transport route 89 provided on the rear side of the sheet postprocessing apparatus 20 as shown in FIGS. 6A and 6B, toward the saddle binding device 27 on the lower side. Two blowing fans 93 are provided on the back cover 101 of the saddle binding device 27. When the cover 101 is closed, the blowing fans 93 are oriented toward the divided tables 75A and 75B, as shown in FIG. 2. When the blowing fans 93 rotate in this state, the air emitted by the blowing fans 93 flows along the upper face of the divided tables 75A and 75B, through the outlet of the transport route 89.

To the output tray 28, the recording sheets P, bound and folded by the saddle binding device 27, are delivered.

Figure 7:
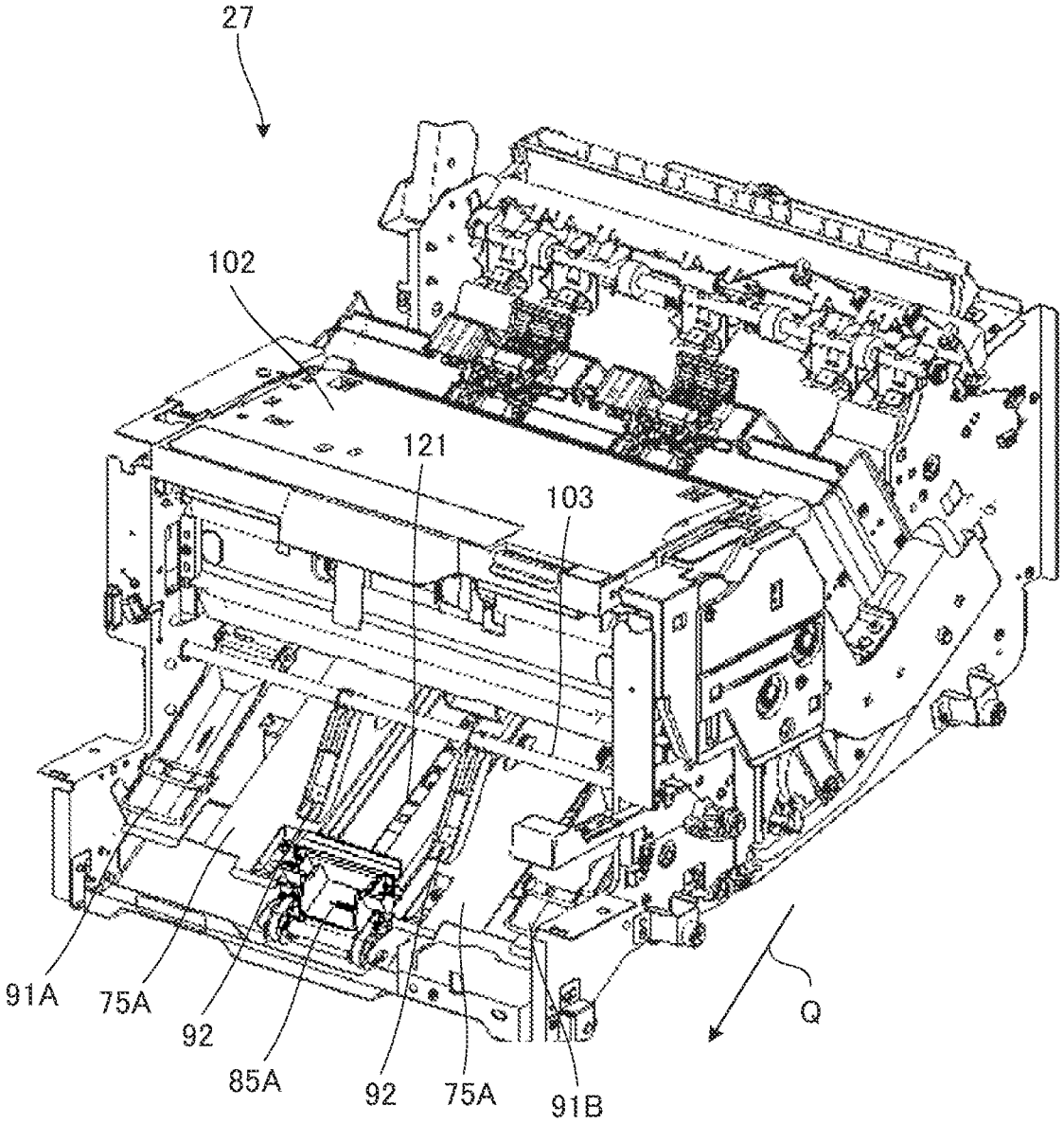
FIG. 7 is a front perspective view of the saddle binding device seen from an obliquely upper position, with an output tray excluded.
Figure 8:
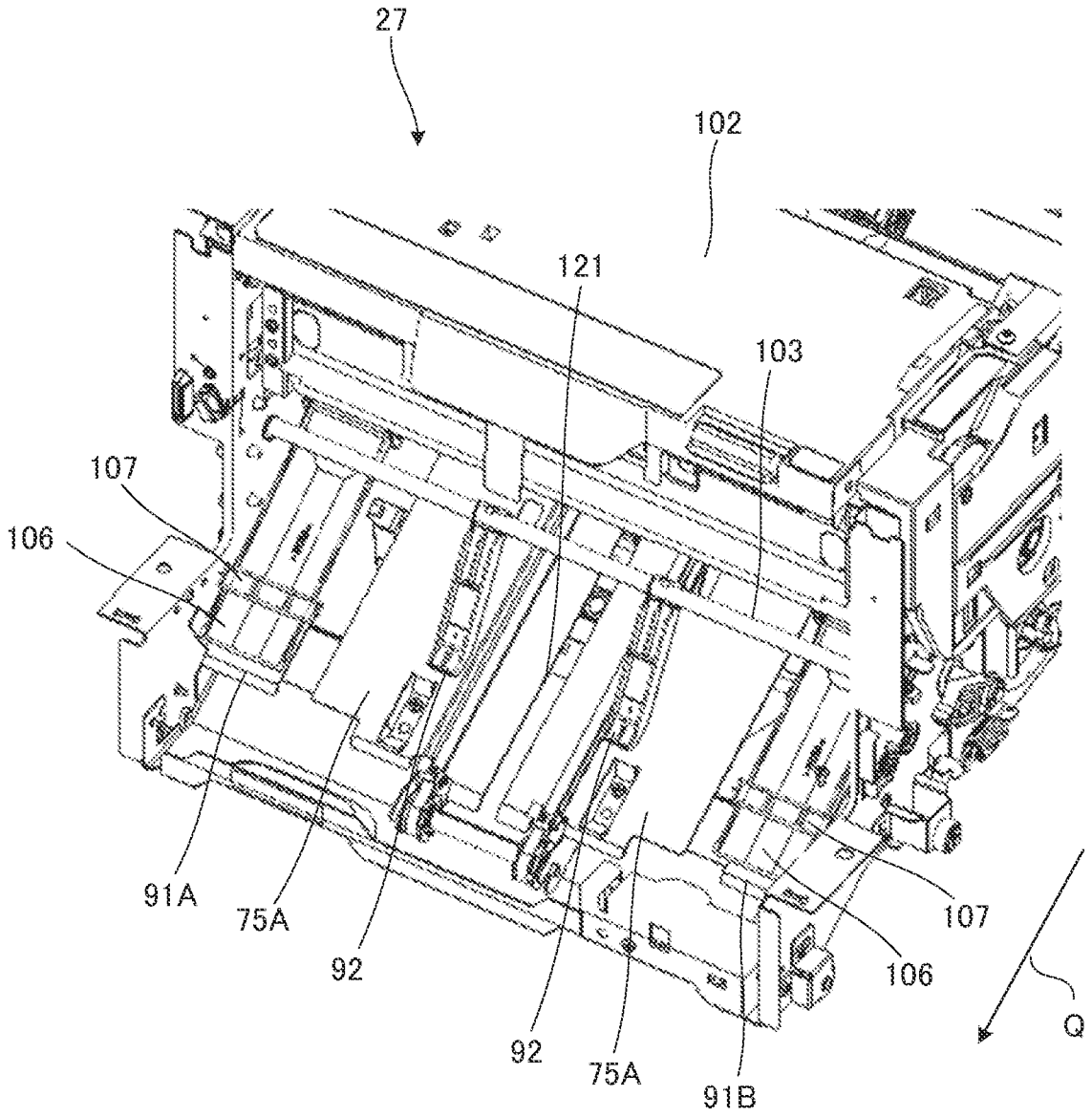
FIG. 8 is an enlarged front perspective view of a divided table and related parts in the saddle binding device, seen from an obliquely upper position.
Figure 9:
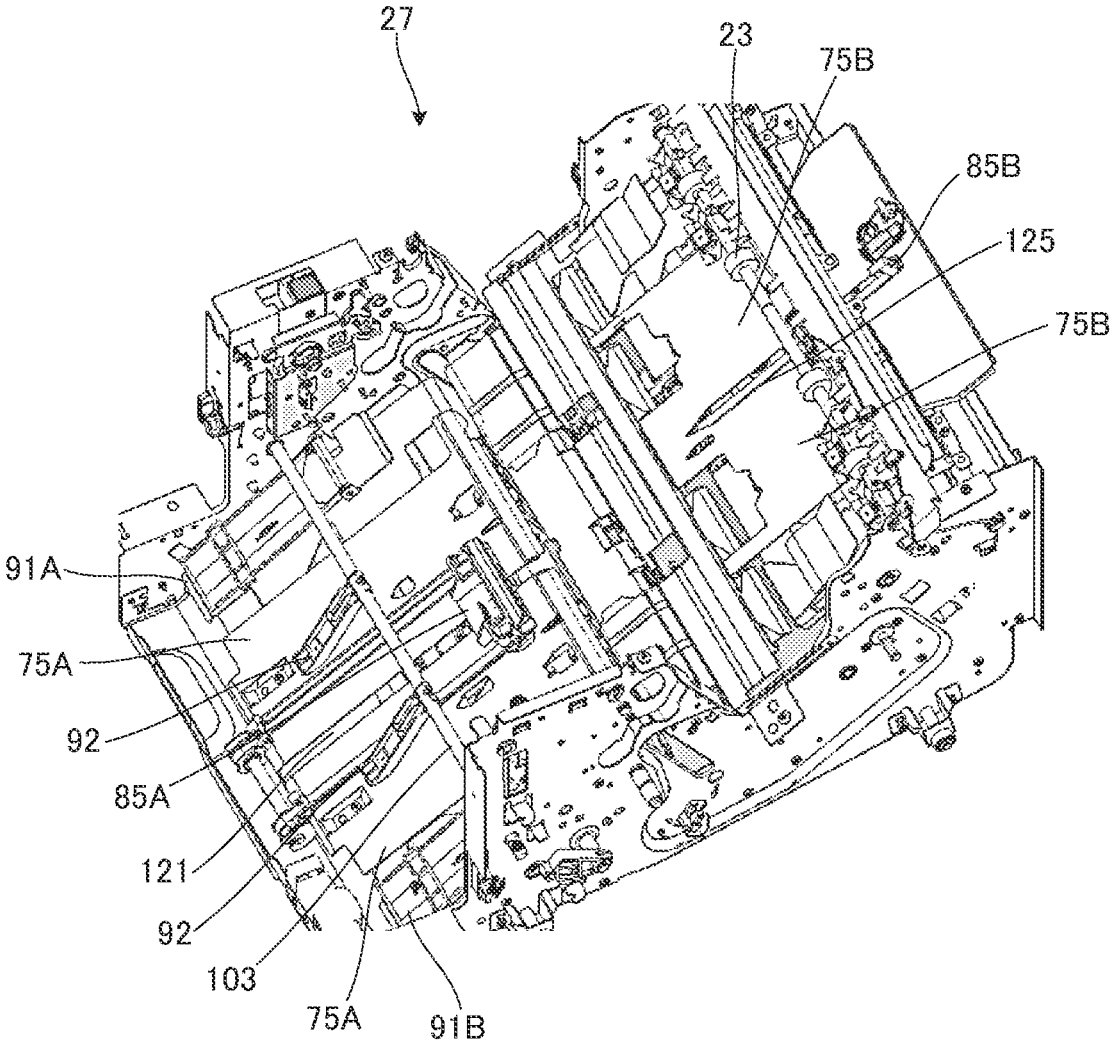
FIG. 9 is a front perspective view of the saddle binding device seen from an obliquely upper position, with an upper cover excluded.

FIG. 7 is a perspective view of the saddle binding device 27 seen from an obliquely upper position, with the output tray 28 shown in FIG. 6 excluded. FIG. 8 is an enlarged front perspective view of the divided table 75A and related parts in the saddle binding device 27, seen from an obliquely upper position. FIG. 9 is a perspective view of the saddle binding device 27, seen from a further upper position than in FIG. 7 and FIG. 8, with the upper cover 102 shown in FIG. 7 and FIG. 8 excluded.

As shown in FIG. 7 to FIG. 9, a shaft 103, extending in the direction orthogonal to the delivery direction Q of the recording sheet P, is provided above the divided table 75A, and the end portions of the shaft 103 are supported by frames on the respective sides of the saddle binding device 27. The shaft 103 is passed through the rear end portion of each of the two first pressing members 92 in the delivery direction, thus to pivotably support the first pressing members 92. The clearance between the first pressing members 92 is determined such that the respective positions of the first pressing members 92 remain within the width of the narrowest recording sheet P to be delivered to the divided table 75A.

Figure 10:
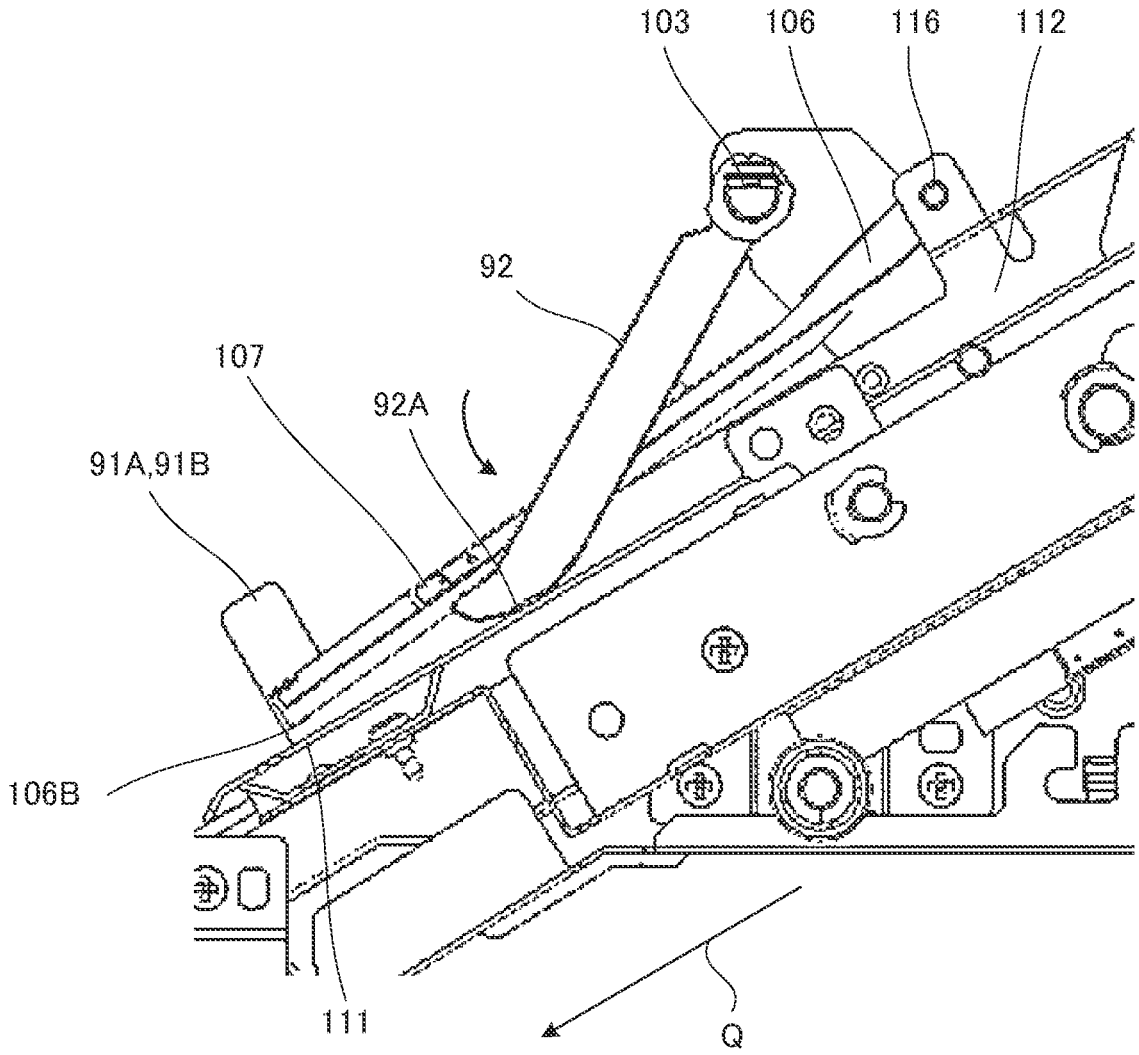
FIG. 10 is a side view showing a first pressing member and related parts, in the saddle binding device.

FIG. 10 is an enlarged side view showing the first pressing member 92 and the related parts. As shown in FIG. 10, the distal end portion of each of the first pressing members 92 is pressed against the divided table 75A, because of the self-weight. In other words, the first pressing members 92 are biased toward the divided table 75A, by the self-weight thereof. The first pressing members 92 each pivot counterclockwise in FIG. 10 about the shaft 103, because of the self-weight, such that the distal end portion 92A is abutted against the divided table 75A. The distal end portion 92A of each of the first pressing member 92 is formed in a smoothly curved arcuate shape, protruding downward when viewed along the width direction of the recording sheet P.

Referring again to FIG. 7 to FIG. 9, the side-edge cursor 91A is provided on one side of the divided table 75A, and the side-edge cursor 91B is provided on the other side of the divided table 75A. Under the divided table 75A, the conversion mechanism is located. The conversion mechanism moves the side-edge cursors 91A and 91B from the corresponding standby position on the respective sides of the divided table 75A, so as to come closer to each other, thereby regulating the positions of the respective side edges of the recording sheet P in the width direction, using the side-edge cursors 91A and 91B.

Figure 11A:
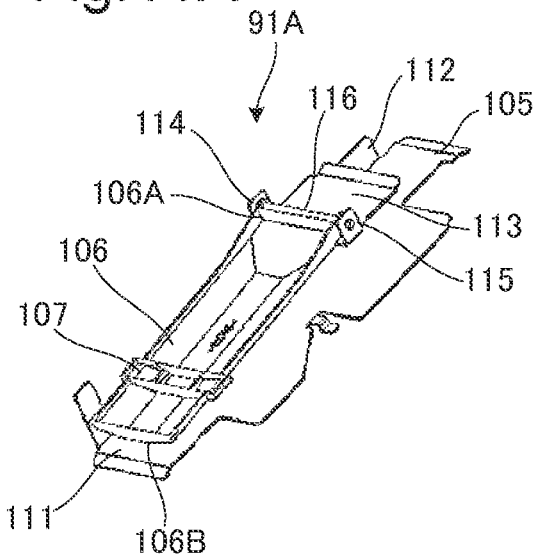
FIG. 11A and FIG. 11B are perspective views showing respective side-edge cursors in the saddle binding device.
Figure 11B:
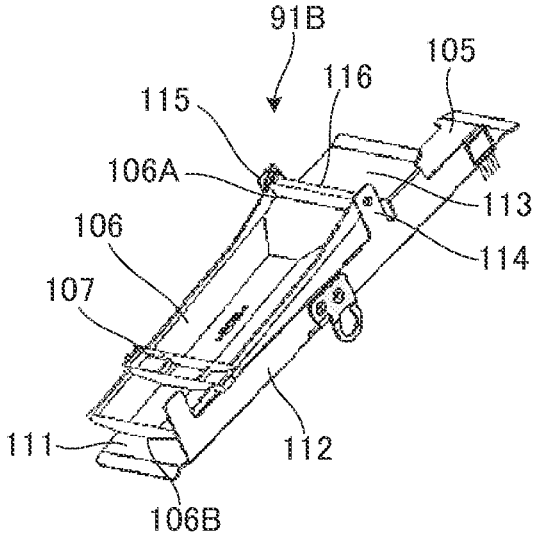
Figure 11C:
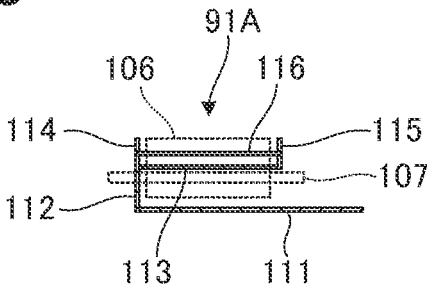
FIG. 11C and FIG. 11D are cross-sectional views showing the respective side-edge cursors.
Figure 11D:
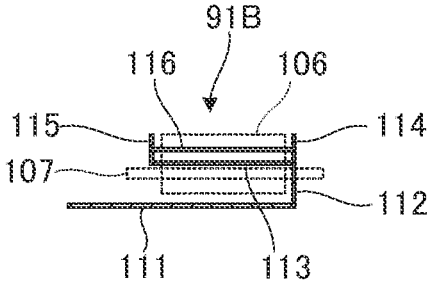
Figure 11E:
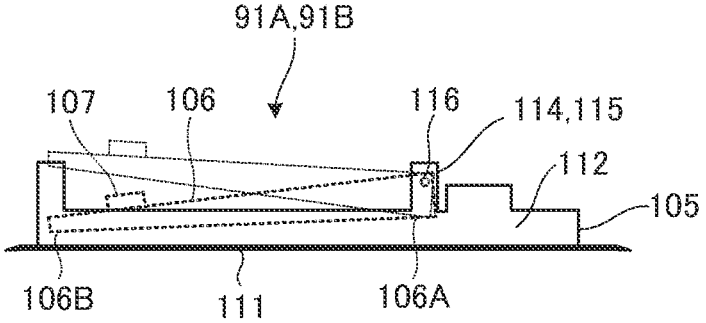
FIG. 11E is a side view showing the side-edge cursors.

The configuration of the side-edge cursors 91A and 91B will be described in further detail hereunder. FIG. 11A and FIG. 11B are perspective views respectively showing the side-edge cursors 91A and 91B. FIG. 11C and FIG. 11D are cross-sectional views respectively showing the side-edge cursors 91A and 91B. FIG. 11E is a side view showing the side-edge cursors 91A and 91B.

As shown in FIG. 11A to FIG. 11E, the side-edge cursors 91A and 91B each include a cursor main body 105, a second pressing member 106, and a stopper 107. The cursor main body 105 includes a bottom plate 111, the side-edge plate 112 bent upward from an outer edge of the bottom plate 111, and a top plate 113 bent inwardly from an upper edge of the side-edge plate 112, and the bottom plate 111 and the top plate 113 are opposed to each other in the up-down direction, with a spacing therebetween. The bottom plate 111 corresponds to the surface on which the recording sheet P is placed. The side-edge plate 112 regulates the position of the side edge of the recording sheet P, upon making contact with the side edge of the recording sheet P.

The side-edge plate 112 includes a support piece 114 protruding upward, and the top plate 113 also includes a support piece 115 bent and protruding upward. The support pieces 114 and 115 serve to support a shaft 116, which is passed through the rear end portion 106A of the second pressing member 106, to support the second pressing member 106 so as to pivot about the shaft 116.

When the recording sheet P is delivered to the divided table 75A through the delivery roller 23, the leading edge of the recording sheet P in the delivery direction enters into between the bottom plate 111 and the top plate 113 spaced from each other, and thus the recording sheet P is placed on the bottom plate 111.

The stopper 107 is fixed to the top portion of the second pressing member 106, such that the end portions of the stopper 107 in the width direction are protruding from the second pressing member 106.

The second pressing member 106 is biased by the self-weight thereof, thus to be pressed against the bottom plate 111. In other words, the second pressing member 106 is biased toward the bottom plate 111 by the self-weight thereof, and set to pivot counterclockwise in FIG. 11E, about the shaft 116. In addition, an end portion of the stopper 107 in the width direction is protruding toward the first pressing member 92, and the other end portion of the stopper 107 in the width direction is protruding toward the side-edge plate 112 of the cursor main body 105. The other end portion of the stopper 107 makes contact with the upper edge of the side-edge plate 112 of the cursor main body 105, thus to delimit the pivotal movement of the distal end portion 106B of the second pressing member 106, so as to set the second pressing member 106 at a position spaced from the bottom plate 111 of the cursor main body 105 by a predetermined distance.

Referring again to FIG. 10, the distal end portion 106B of the second pressing member 106 is located downstream of the distal end portion 92A of the first pressing member 92, in the delivery direction. In other words, in the delivery direction Q of the recording sheet P, the position where the distal end portion 106B of the second pressing member 106 presses the recording sheet P is located downstream of the position where the distal end portion 92A of the first pressing member 92 presses the recording sheet P. Thus, the position where the distal end portion 92A of the first pressing member 92 presses the recording sheet P and the position where the distal end portion 106B of the second pressing member 106 presses the recording sheet P are different from each other.

Further, as shown in FIG. 7 to FIG. 9, the divided table 75A includes a slit 121, formed at the central portion thereof in the width direction. The leading edge cursor 85A is connected to the revolving belt 76A located under the divided table 75A, through the slit 121. When the revolving belt 76A is made to revolve by the motor as mentioned above, the leading edge cursor 85A is moved.

Figure 12A:
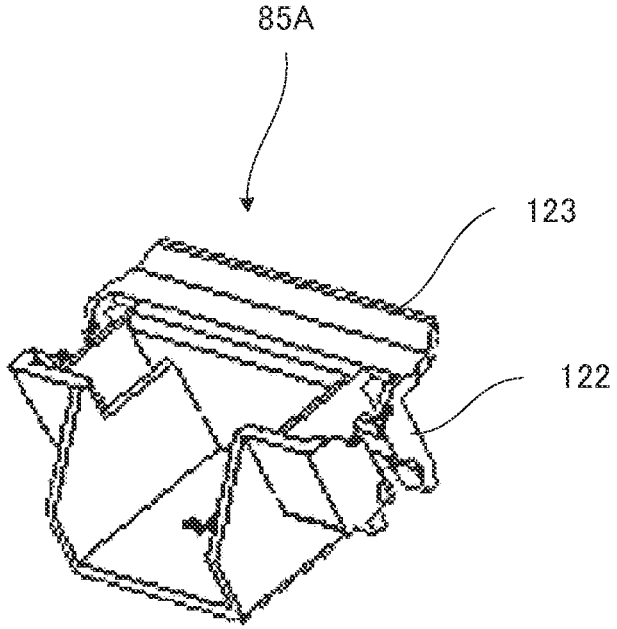
FIG. 12A and FIG. 12B are a perspective view and a side view each showing a leading edge cursor in the saddle binding device.
Figure 12B:
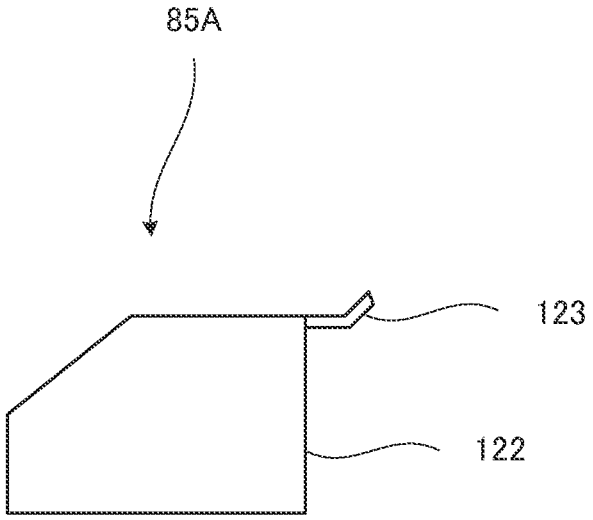
Figure 13:
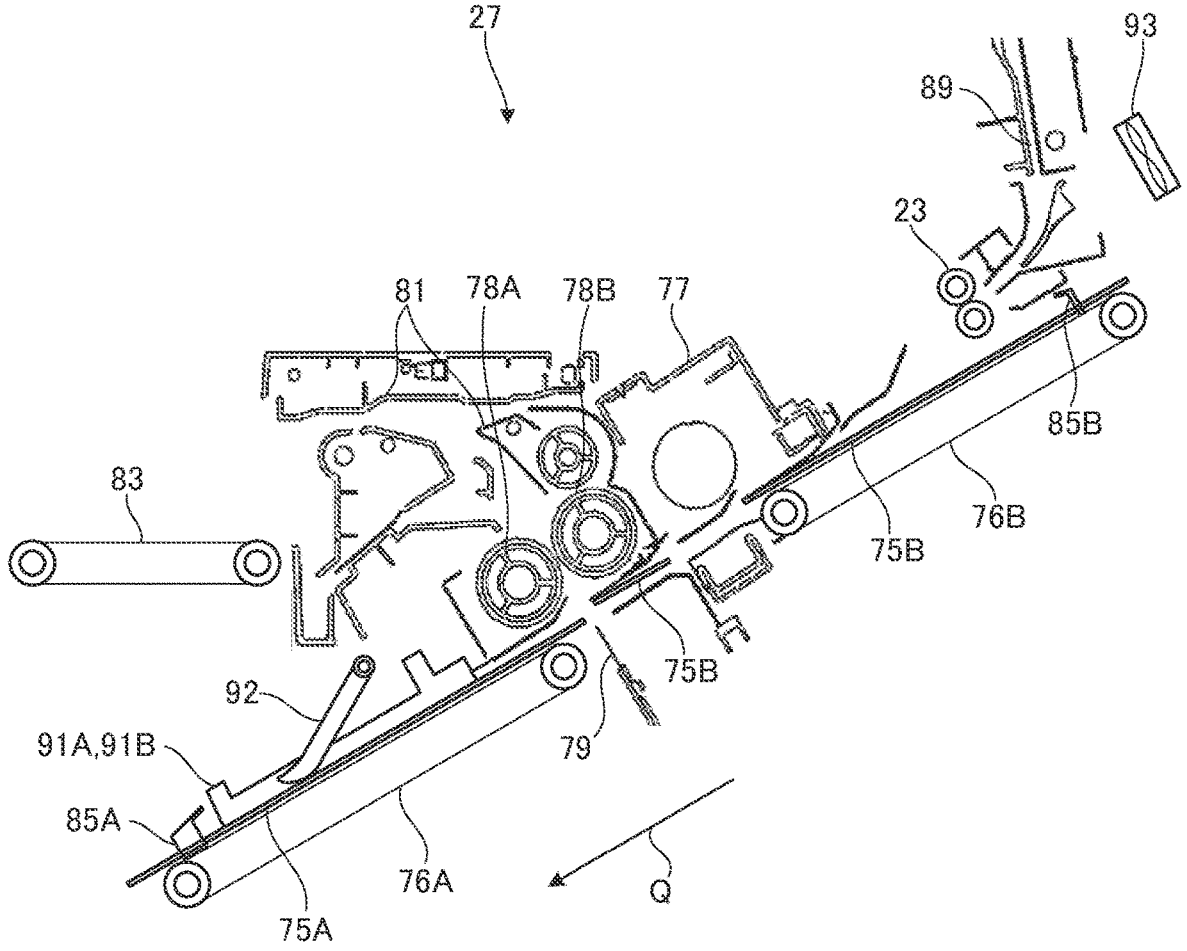
FIG. 13 is a further enlarged cross-sectional view of the saddle binding device in the sheet postprocessing apparatus.

FIG. 12A and FIG. 12B are a perspective view and a side view, each showing the leading edge cursor 85A. As shown in FIG. 12A and FIG. 12B, the leading edge cursor 85A includes an abutment surface 122 against which the leading edge of the recording sheet P is abutted, and a guide piece 123 formed along the upper edge of the abutment surface 122, to guide the leading edge of the recording sheet P to the abutment surface 122.

Further, as shown in FIG. 7 to FIG. 9, the divided table 75B includes a slit 125, formed at the central portion thereof in the width direction, and the trailing edge cursor 85B is connected to the revolving belt 76B located under the divided table 75B, through the slit 125. When the revolving belt 76B is made to revolve by the motor as mentioned above, the trailing edge cursor 85B is moved.

Now, the leading edge cursor 85A receives the recording sheets P delivered one by one, so as to sequentially align the leading edges of the recording sheet P in the delivery direction, and therefore, basically, the recording sheet P is barely likely to be damaged, for example such that the leading edge is bent. However, when the recording sheet P suffers a decline in rigidity, or the friction between the recording sheet P and the divided tables 75A and 75B is increased, because of the recording sheet P becoming wet owing to the application of the ink through the ink jet printing process, it becomes difficult for the recording sheet P to smoothly move on the divided tables 75A and 75B. Accordingly, the transport speed of the recording sheet P on the divided tables 75A and 75B may become slower, compared with the case where the recording sheet P freely slides down along the divided tables 75A and 75B. In such a case, the recording sheet P delivered to the divided tables 75A and 75B may fail to smoothly proceed to the leading edge cursor 85A, and the leading edge of the recording sheet P may fail to reach the leading edge cursor 85A.

When the trailing edge cursor 85B is abutted against the trailing edge of the recording sheet P on the divided tables 75A and 75B, in the mentioned state, the recording sheet P is pushed forward with an excessive force by the trailing edge cursor 85B, while being subjected to the increased friction with the divided tables 75A and 75B. As result, the recording sheet P may be damaged, such that the trailing edge of the recording sheet P is bent, or that the recording sheet P is distorted and bent upward.

Therefore, the saddle binding device 27 of the sheet postprocessing apparatus 20 according to this embodiment includes a plurality of slip sheets 131 provided on the upper face of the divided tables 75A and 75B, each having a belt-like shape and extending along the delivery direction Q of the recording sheet P, with a clearance between each other in the width direction orthogonal to the delivery direction Q.

Figure 14A:
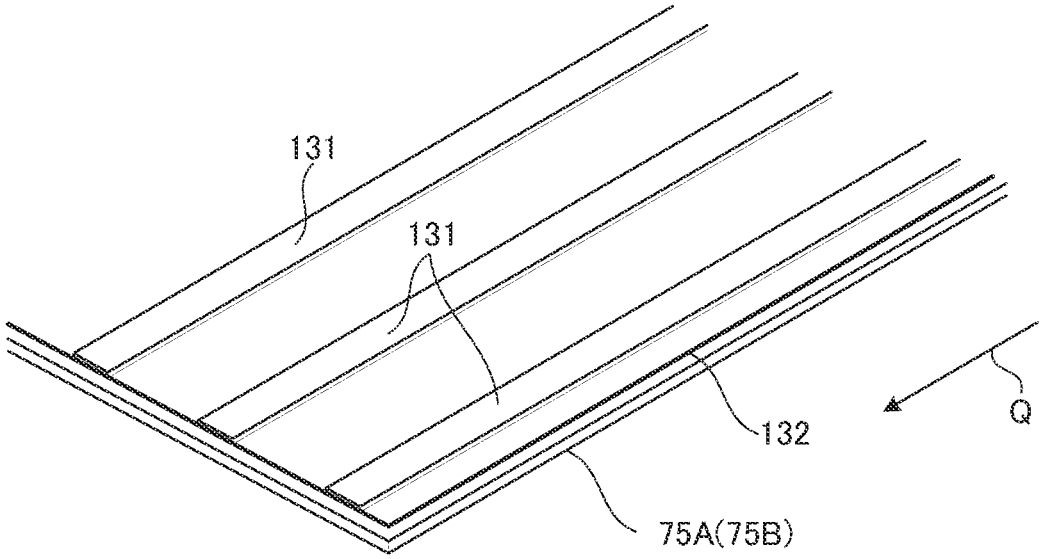
FIG. 14A and FIG. 14B are a perspective view and a cross-sectional view respectively, showing the divided table, a PET sheet adhered to the upper face of the divided table, and a slip sheet adhered to the upper face of the PET sheet.
Figure 14B:
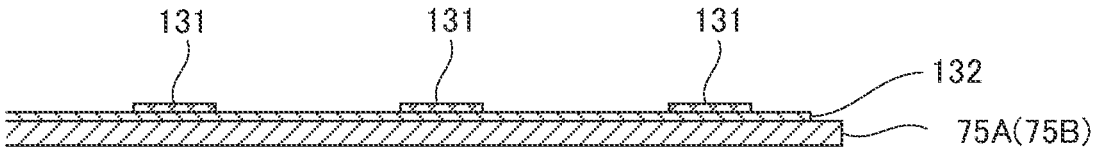

FIG. 14A and FIG. 14B are a perspective view and a cross-sectional view respectively, showing the divided table 75A, a polyethylene terephthalate (PET) sheet 132 adhered to the upper face of the divided table 75A, and the slip sheets 131 adhered to the upper face of the PET sheet 132. The PET sheet 132 and the slip sheets 131 are also provided on the divided table 75B, in the similar configuration.

As shown in FIG. 14A and FIG. 14B, the PET sheet 132 having a uniform thickness is adhered to a substantially entire region of the flat upper face of the divided table 75A, and the plurality of slip sheets 131, each having a uniform thickness, are adhered to the upper face of the PET sheet 132. In other words, the slip sheets 131 are adhered to the upper face of the divided table 75A, via the PET sheet 132. The slip sheets 131 each have a belt-like shape, and are extending along the delivery direction Q of the recording sheet P, with a clearance between each other in the width direction orthogonal to the delivery direction Q. The slip sheets 131 are each formed of an ultra-high-molecular-weight polyethylene sheet, lower in surface friction than the PET sheet 132.

The recording sheet P contacts, upon being delivered to the divided tables 75A and 75B, the surface of the slip sheets 131 having the low surface friction. In addition, the area on the surface of the recording sheet P in contact with the surface of the slip sheets 131 is smaller than the entire surface area of the recording sheet P. In other words, the area on the recording sheet P not in contact with the surface of the slip sheets 131 is not in contact with the PET sheet 132 either. Therefore, the decline in transport speed of the recording sheet P, which may otherwise be incurred when the recording sheet P is delivered to the divided tables 75A and 75B, can be prevented, so that the recording sheet P can be smoothly transported along the surface of the slip sheets 131.

For example, a first one of the recording sheet P, delivered to the divided tables 75A and 75B through the delivery roller 23, slides on the surface of the slip sheets 131, thus moving smoothly. In addition, the air emitted from the blowing fans 93 flows along the upper face of the divided tables 75A and 75B, through the outlet of the transport route 89, which facilitates the first recording sheet P to move forward. Thus, the leading edge of the first recording sheet P promptly reaches the leading edge cursor 85A.

Even though the leading edge of the recording sheet P delays in reaching the leading edge cursor 85A, the recording sheet P can be encouraged to move forward, simply by a soft contact of the trailing edge cursor 85B with the trailing edge of the recording sheet P moving on the divided tables 75A and 75B, instead of a contact with a certain force, so that the leading edge of the recording sheet P is properly abutted against the leading edge cursor 85A, thus to be set in position. Therefore, the trailing edge of the recording sheet P can be prevented from being damaged or bent.

Thereafter, the second recording sheet P slides along the surface of the slip sheets 131, through the upstream region in the delivery direction Q of the recording sheet P, and then moves along the upper face of the first recording sheet P, through the downstream region in the delivery direction Q, with the assistance of the airflow from the blowing fan 93, from the upstream side toward the downstream side in the delivery direction Q. In this case, the leading edge of the first recording sheet P is assuredly in proper contact with the leading edge cursor 85A, unlike in the case where the slip sheets 131 are not provided. Accordingly, the second recording sheet P also promptly moves forward along the upper face of the first recording sheet P, and therefore the leading edge of the second recording sheet P also promptly reaches the leading edge cursor 85A. Moreover, the respective positions of the first and second recording sheets P in the delivery direction are more accurately aligned with each other, compared with the case where the slip sheets 131 are not provided.

Through the mentioned process, the respective leading edges of the recording sheets P are accurately aligned with each other by the leading edge cursor 85A, on the divided tables 75A and 75B.

Further, since the belt-like slip sheets 131 extend in the delivery direction Q, with a clearance between each other in the direction orthogonal to the delivery direction Q, a surface with dips and bumps is formed, with the surfaces of the slip sheets 131 constituting the bumps and the surface of the PET sheet 132 exposed between the slip sheets 131 constituting the dips. The recording sheet P is only in contact with the surfaces of the slip sheets 131 (bumps), and slightly spaced from the dips between the slip sheets 131, along which the air emitted from the blowing fan 93 flows. Therefore, the recording sheet P is prevented from making close contact with the slip sheets 131 and the PET sheet 132, but slides along the slip sheets 131 at a position slightly above the PET sheet 132, even though the recording sheet P is wet with ink. As result, the leading edges of the recording sheets P are properly aligned by the leading edge cursor 85A. In addition, the recording sheets P are encouraged to move forward by being contacted by the trailing edge cursor 85B, so that the leading edges of the recording sheets P are proper aligned with each other upon being abutted against the leading edge cursor 85A, which naturally enables the trailing edges of the recording sheet P to be also aligned with each other. Thus, the trailing edge of the recording sheet P can be prevented from being damaged or bent.

Here, each time the recording sheet P is delivered to the divided tables 75A and 75B, the drive controller 56 either causes the revolving belt 76A to revolve, thereby moving the leading edge cursor 85A toward the trailing edge cursor 85B, or causes the revolving belt 76B to revolve, thereby moving the trailing edge cursor 85B toward the leading edge cursor 85A, thus setting the trailing edge cursor 85B at a position spaced from the leading edge cursor 85A, by a predetermined distance slightly longer than the length of the recording sheet P (e.g., 1 mm longer). In this case, the trailing edge cursor 85B is kept from contacting the trailing edge of the recording sheet P delivered to the divided tables 75A and 75B, or can only make a soft contact, not a strong contact, so that the trailing edge of the recording sheet P is set in position. The predetermined distance slightly longer than the length of the recording sheet P refers to, for example, approximately 0.2 to 0.5% of the length of the recording sheet P, which corresponds to approximately 1 mm in the case of A4 size having the length of 297 mm. It is to be noted, in this case, that the recording sheets P, delivered from the image forming apparatus 10 to the saddle binding device 27 of the sheet postprocessing apparatus 20 as the object of one postprocessing session, should all be of the same size.

The image forming apparatus 10 forms the image of the source document on the recording sheet P, through the ink jet process. The application of the ink may prolong the length of the recording sheet P in the delivery direction. An increase in ejection amount of the ink from the line heads 15 onto the recording sheet P naturally leads to an increase in amount of the ink stuck to the recording sheet P, thereby prolonging the recording sheet P further.

In this case also, the recording sheet P may be damaged, such that the trailing edge of the recording sheet P is bent, or that the recording sheet P is distorted and bent upward, because of being pushed by the trailing edge cursor 85B with an excessive force.

Accordingly, the length of the recording sheet P may be calculated on the basis of the ejection amount of the ink onto the recording sheet P, and the trailing edge cursor 85B may be set at the position spaced from the leading edge cursor 85A by a predetermined distance slightly longer than the calculated length of the recording sheet P.

For example, a data table, in which the ejection amount of the ink onto the recording sheet P, and the increase rate of the length of the recording sheet P are associated with each other, may be made up in advance, and stored in a storage device of the sheet postprocessing apparatus 20.

The controller 46 of the image forming apparatus 10 acquires the ink ejection amount from the line heads 15 onto the recording sheet P, each time an image is formed thereon, and outputs a control signal indicating the size of the recording sheet P (length and width) and the ink ejection amount, to the drive controller 56 of the sheet postprocessing apparatus 20, through the interface 47.

The drive controller 56 of the sheet postprocessing apparatus 20 receives the control signal indicating the size of the recording sheet P and the ink ejection amount through the interface 57, each time the recording sheet P is delivered from the image forming apparatus 10, and retrieves from the data table the increase rate of the length of the recording sheet P, corresponding to the ink ejection amount indicated by the control signal, to calculate the length of the recording sheet P, by multiplying the length thereof indicated by the control signal, by the increase rate retrieved from the data table.

Then the drive controller 56 either causes the revolving belt 76A to revolve, thereby moving the leading edge cursor 85A toward the trailing edge cursor 85B, or causes the revolving belt 76B to revolve, thereby moving the trailing edge cursor 85B toward the leading edge cursor 85A, thus setting the trailing edge cursor 85B at the position spaced from the leading edge cursor 85A, by the predetermined distance slightly longer than the length of the recording sheet P calculated as above.

Figure 15:
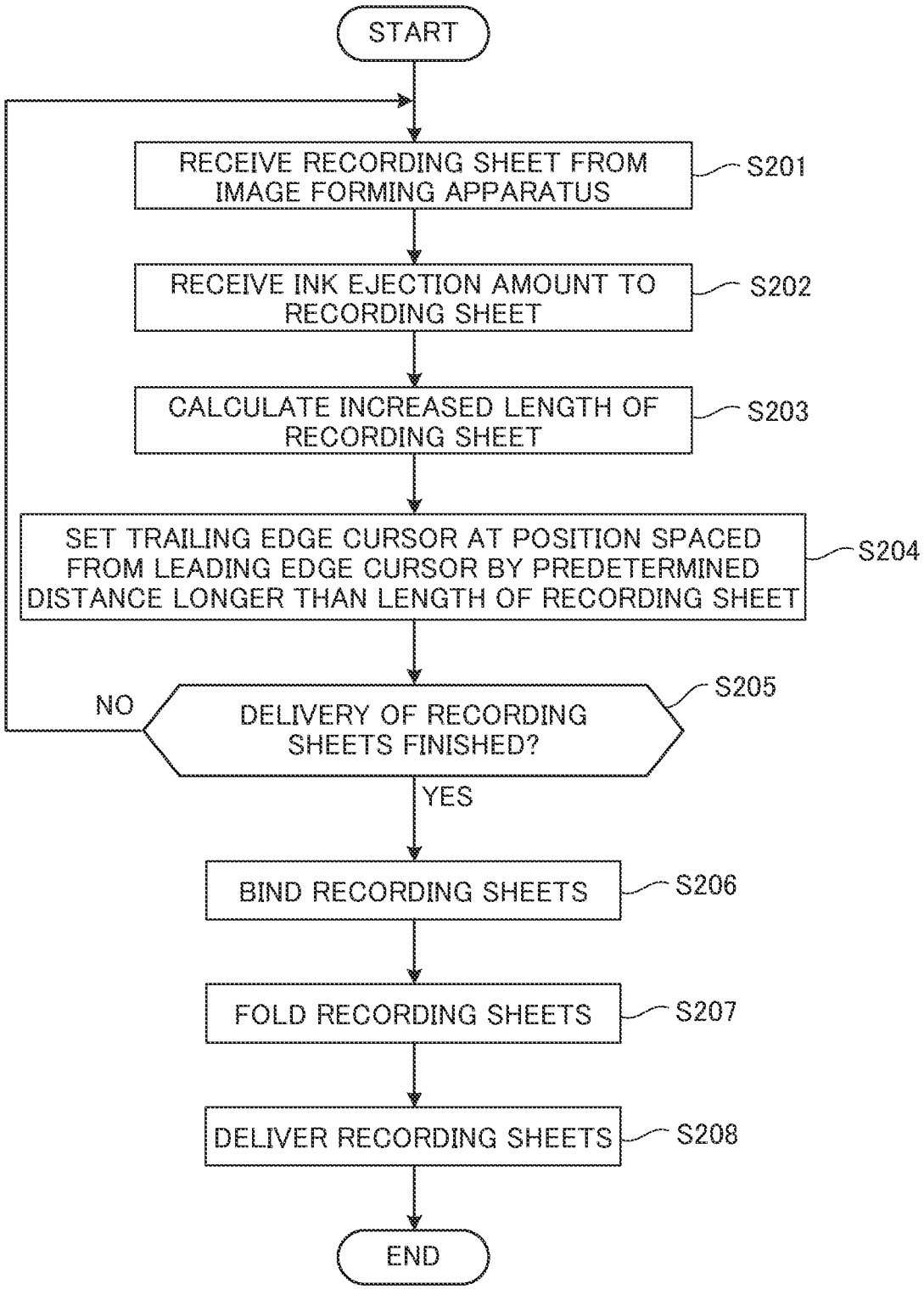
FIG. 15 is a flowchart showing a process performed each time the recording sheet is delivered to the divided tables, including moving a trailing edge cursor away from the leading edge cursor, by a distance slightly longer than the length of the recording sheet, thereby setting the trailing edge cursor in position, binding the sheaf of recording sheets on the divided tables, and delivering the same.

FIG. 15 is a flowchart showing a process performed each time the recording sheet P is delivered to the divided tables 75A and 75B, including moving the trailing edge cursor 85B away from the leading edge cursor 85A, by a distance slightly longer than the length of the recording sheet P, thereby setting the trailing edge cursor 85B in position, binding the sheaf of the recording sheets P on the divided tables 75A and 75B, and delivering the same.

The controller 46 of the image forming apparatus 10 outputs a control signal indicating the size of the recording sheet P and the ink ejection amount, to the drive controller 56 of the sheet postprocessing apparatus 20 through the interface 47, with respect to each of the recording sheets P.

The drive controller 56 of the sheet postprocessing apparatus 20 receives the control signal indicating the size of the recording sheet P and the ink ejection amount, through the interface 57 (S202), each time the recording sheet P is delivered from the image forming apparatus 10 (S201). Then the drive controller 56 retrieves the increase rate of the length of the recording sheet P, corresponding to the ink ejection amount indicated by the control signal, and calculates the increased length of the recording sheet P, by multiplying the length of the recording sheet P indicated by the control signal, by the increase rate retrieved from the data table (S203).

The drive controller 56 either causes the revolving belt 76A to revolve, thereby moving the leading edge cursor 85A toward the trailing edge cursor 85B, or causes the revolving belt 76B to revolve, thereby moving the trailing edge cursor 85B toward the leading edge cursor 85A, thus setting the trailing edge cursor 85B at the position spaced from the leading edge cursor 85A, by the predetermined distance slightly longer than the length of the recording sheet P calculated as above (S204). Such an operation enables the trailing edge cursor 85B to make contact with the trailing edge of the recording sheet P with an appropriate pressure, thereby allowing the trailing edges of the recording sheets P to be properly aligned, without being subjected to an excessive force.

The drive controller 56 causes the leading edge cursor 85A and the trailing edge cursor 85B to move to the respective standby positions. Accordingly, the recording sheet P moves on the divided tables 75A and 75B, so as to follow the movement of the leading edge cursor 85A.

The drive controller 56 of the sheet postprocessing apparatus 20 stands by for receipt of a control signal indicating that the delivery of the recording sheets P has been finished, and repeats the operation from S201, until such control signal is received (No at S205).

When all the recording sheets P are delivered to the sheet postprocessing apparatus 20, the controller 46 of the image forming apparatus 10 outputs the control signal indicating that the delivery has been finished, to the controller 56 of the sheet postprocessing apparatus 20, through the interface 47. Upon receipt of such control signal (Yes at S205), the drive controller 56 of the sheet postprocessing apparatus 20 causes the revolving belts 76A and 76B to revolve, thereby moving the recording sheets P on the divided tables 75A and 75B using the leading edge cursor 85A and the trailing edge cursor 85B, such that, as shown in FIG. 3B, the center of the recording sheets P in the longitudinal direction (delivery direction) is set at the position for the stapling operation by the stapling device 77, and the stapling device 77 performs the stapling operation onto the center of the recording sheets P (S206).

The drive controller 56 further causes the revolving belts 76A and 76B to revolve, thereby moving the recording sheets P on the divided tables 75A and 75B using the leading edge cursor 85A and the trailing edge cursor 85B, such that, as shown in FIG. 3C, the center of the recording sheets P in the longitudinal direction is set in position, in the space between the divided tables 75A and 75B, and then causes the folding rollers 78A and 78B, and the folding blade 79, to fold the recording sheets P, as shown in FIG. 3D (S207). Thereafter, the drive controller 56 causes the folding rollers 78A and 78B, and the delivery conveyor 83, to deliver the recording sheet P folded as above, to the output tray 28 (S208).

According to this embodiment, as described above, the plurality of belt-like shaped slip sheets 131, extending along the delivery direction Q of the recording sheet P, with a clearance between each other in the direction orthogonal to the delivery direction Q, are provided on the upper face of the divided tables 75A and 75B. Accordingly, the recording sheet P can easily move forward, by sliding on the slip sheets 131. In addition, the trailing edge cursor 85B is set at the position spaced from the leading edge cursor 85A by the predetermined distance slightly longer than the length of the recording sheet P, which allows the trailing edge cursor 85B to make contact with the trailing edge of the recording sheet P with an appropriate pressure. Therefore, the trailing edges of the recording sheets P can be aligned with each other without being subjected to an excessive pressure, and the damage of the recording sheet P, for example a damage in the portion in the proximity of the trailing edge, can be prevented.

Although the sheet postprocessing apparatus 20 includes the drive controller 56 in the foregoing embodiment, the drive controller 56 may be excluded, and the controller 46 may be configured to directly control the sheet postprocessing apparatus 20.

For example, in the case of the aforementioned existing sheet loading mechanism, the leading edges of the sheets are received by the sheaf lifting cursor, thus to be aligned with each other, after which the sheaf lowering cursor is moved so as to be abutted against the trailing edges of the sheets, to align the trailing edges of the sheets.

In addition, in the case of the existing sheet postprocessing apparatus, the leading edges of the sheets are received by the lower moving member, after which the upper moving member and the lower moving member are moved by the distance corresponding to the length of the sheet, to align the positions of the sheets stacked on the sheet loading section. In this case also, accordingly, the upper moving member is abutted against the trailing edges of the sheet, to align the same.

The sheaf lifting cursor or the lower moving member is configured to align the leading edges of the sheets, by passively receiving the sheets, and therefore the sheet is barely likely to be damaged, such that the leading edge is bent. However, when the sheaf lowering cursor or the upper moving member is abutted against the trailing edge of the sheet, the sheet may be damaged, such that the trailing edge of the sheet is bent. Further, when the friction between the sheet and the sheet table, or the sheet loading section, is large, the sheet may fail to promptly move, upon being pushed by the sheaf lowering cursor or the upper moving member, and becomes more likely to be damaged, for example in a portion in the proximity of the trailing edge.

In particular, when the image is formed on the sheet through the ink jet process, the sheet suffers a decline in rigidity because of becoming wet, and also becomes difficult to move forward, owing to an increase in friction between the sheet and the sheet table or the sheet loading section. Therefore, the sheet becomes more likely to be damaged.

With the arrangement according to the foregoing embodiment, in contrast, the sheets can be stacked on the tray with the edges properly aligned with each other, without incurring a damage of the sheet.

Although the image forming apparatus 10 is exemplified by the image forming apparatus based on the ink jet process in the foregoing embodiment, the disclosure is also applicable to an image forming apparatus based on electrophotography.

The configurations and processings described in the foregoing embodiments with reference to FIG. 1 to FIG. 15 are merely exemplary, and in no way intended to limit the disclosure to those configurations and processings.

While the present disclosure has been described in detail with reference to the embodiments thereof, it would be apparent to those skilled in the art the various changes and modifications may be made therein within the scope defined by the appended claims.

What is claimed is:

1. A sheet postprocessing apparatus comprising:

a table configured to receive a plurality of sheets delivered thereto, and inclined downward toward a downstream side in a sheet delivery direction;

a leading edge cursor provided on a far side on the table in the delivery direction, and configured to align respective leading edges of the sheets abutted against the leading edge cursor;

a postprocessing device including a stapling device that binds a central portion in the delivery direction, of the sheets stacked on the table, and a center folding device that folds the sheets along the central portion, wherein the table includes an upper face region that allows the sheet to slide thereon, and a plurality of slip sheets of a belt-like shape, each extending on the upper face region along the delivery direction, with a clearance between each other in a width direction orthogonal to the delivery direction, the sheet postprocessing apparatus further comprising a PET sheet adhered to a flat upper face of the table, wherein the slip sheets are adhered to the table on a side of the upper face, via the PET sheet.

2. The sheet postprocessing apparatus according to claim 1, wherein respective surfaces of the slip sheets are located higher than a surface of the upper face region, the slip sheets are formed of a material lower in surface friction than the surface of the upper face region, and the slip sheets and the upper face region are provided on the table, such that the surfaces of the slip sheets make contact with the sheet delivered to the table, and that the surface of the upper face region is kept from contacting the sheet.

3. The sheet postprocessing apparatus according to claim 1, wherein the slip sheets are each formed of an ultra-high-molecular-weight polyethylene sheet.

4. An image forming system comprising:

an image forming apparatus including an image forming device that forms an image of a source document on a sheet; and a sheet postprocessing apparatus configured to receive the sheet from the image forming apparatus, and perform postprocessing, the sheet postprocessing apparatus comprising:

a table configured to receive a plurality of sheets delivered thereto, and inclined downward toward a downstream side in a sheet delivery direction;

a leading edge cursor provided on a far side on the table in the delivery direction, and configured to align respective leading edges of the sheets abutted against the leading edge cursor;

a postprocessing device including a stapling device that binds a central portion in the delivery direction, of the sheets stacked on the table, and a center folding device that folds the sheets along the central portion, wherein the table includes an upper face region that allows the sheet to slide thereon, and a plurality of slip sheets of a belt-like shape, each extending on the upper face region along the delivery direction, with a clearance between each other in a width direction orthogonal to the delivery direction, wherein the image forming device of the image forming apparatus forms the image of the source document on the sheet using ink, through an ink jet process, the image forming system further comprising:

a trailing edge cursor opposed to the leading edge cursor in the sheet delivery direction;

a driver that causes the leading edge cursor and the trailing edge cursor to reciprocate along the sheet delivery direction; and a controller that controls the driver, wherein the controller moves the trailing edge cursor by controlling the driver, when the leading edges of the sheets are abutted against the leading edge cursor, from an upstream side in the delivery direction, to a position spaced from the leading edge cursor by a predetermined distance slightly longer than a length of the sheet, wherein the predetermined distance, by which the trailing edge cursor is to be spaced from the leading edge cursor, is prolonged in proportion to an increase in ink ejection amount on the sheet, from the image forming device.

* * * * *